US008387279B2

(12) United States Patent
Pauk et al.

(10) Patent No.: US 8,387,279 B2
(45) Date of Patent: Mar. 5, 2013

(54) SHOE SOLE FOR INCREASING INSTABILITY

(75) Inventors: Matthew R. Pauk, Boston, MA (US); Andrew W. Spieth, Boston, MA (US); Patrick Y. Choe, Boston, MA (US); Timothy Downing, Boston, MA (US); Sean Murphy, Boston, MA (US)

(73) Assignee: New Balance Athletic Shoe, Inc., Boston, MA (US)

( * ) Notice: Subject to any disclaimer, the term of this patent is extended or adjusted under 35 U.S.C. 154(b) by 450 days.

(21) Appl. No.: 12/729,758

(22) Filed: Mar. 23, 2010

(65) Prior Publication Data

US 2010/0236096 A1 Sep. 23, 2010

Related U.S. Application Data

(60) Provisional application No. 61/210,871, filed on Mar. 23, 2009.

(51) Int. Cl.
*A43B 13/00* (2006.01)

(52) U.S. Cl. ..... 36/25 R; 36/27

(58) Field of Classification Search ..... 36/27, 28, 36/25 R, 30 R, 35 R, 37, 38
See application file for complete search history.

(56) References Cited

U.S. PATENT DOCUMENTS

| | | | | |
|---|---|---|---|---|
| 5,185,943 | A * | 2/1993 | Tong et al. | 36/28 |
| 5,337,492 | A | 8/1994 | Anderie et al. | |
| 5,720,118 | A | 2/1998 | Mayer et al. | |
| 6,216,365 | B1 | 4/2001 | Cohen | |
| 6,578,290 | B1 * | 6/2003 | Meynard | 36/103 |
| 6,860,034 | B2 | 3/2005 | Schmid | |
| 6,920,705 | B2 * | 7/2005 | Lucas et al. | 36/25 R |
| 6,944,973 | B2 | 9/2005 | Goodwin | |
| 7,082,702 | B2 * | 8/2006 | Cretinon | 36/88 |
| 7,159,339 | B2 * | 1/2007 | Mathieu et al. | 36/30 R |
| 7,314,125 | B2 * | 1/2008 | Smaldone et al. | 188/372 |
| 7,395,616 | B2 | 7/2008 | Fallon | |
| 7,401,418 | B2 * | 7/2008 | Wyszynski et al. | 36/28 |
| 7,421,805 | B2 | 9/2008 | Geer | |
| 7,549,236 | B2 * | 6/2009 | Dillon et al. | 36/30 R |
| 7,987,618 | B2 * | 8/2011 | Nishiwaki et al. | 36/28 |
| 8,127,467 | B2 * | 3/2012 | Koyama | 36/25 R |
| 8,151,485 | B2 * | 4/2012 | Hurd et al. | 36/27 |
| 8,220,185 | B2 * | 7/2012 | Baker et al. | 36/103 |
| 2007/0240331 | A1 | 10/2007 | Borel | |
| 2009/0013556 | A1 * | 1/2009 | Nishiwaki et al. | 36/28 |
| 2009/0178303 | A1 | 7/2009 | Hurd et al. | |
| 2011/0185590 | A1 * | 8/2011 | Nishiwaki et al. | 36/28 |
| 2012/0079747 | A1 * | 4/2012 | Seo | 36/25 R |

OTHER PUBLICATIONS

International Search Report and Written Opinion for Internation Application No. PCT/US2010/028310, as mailed on May 19, 2010.

* cited by examiner

*Primary Examiner* — Marie Patterson
(74) *Attorney, Agent, or Firm* — New Balance Athletic Shoe, Inc.

(57) ABSTRACT

A shoe sole and shoe are provided for offsetting a wearer's side-to-side balance to encourage a wearer's conditioning and toning. The shoe sole includes a midsole width that underlies and supports a wearer's foot, and an upper midsole portion undercut at its peripheral sidewall around the heel to define a horizontal indentation. A lower midsole portion has a corresponding "undercut" in its upper surface that angles downward and outward from the indentation. The depth of the indentation forms a balancing portion between the medially and laterally placed indentations that is narrower than the midsole width, thereby forcing the wearer to adjust one's walking gait to maintain balance over the balancing portion. A structure with a base portion can be disposed along the indentation with upward and or downward extending extensions disposed along the peripheral sidewall. The structure can include leaf springs extending transversely over a central midsole portion.

31 Claims, 21 Drawing Sheets

SHOE SOLE FOR INCREASING INSTABILITY

CROSS-REFERENCE TO RELATED APPLICATIONS

This application claims priority to U.S. Provisional Application Ser. No. 61/210,871, filed Mar. 23, 2009, the entirety of which is incorporated herein by reference thereto.

TECHNICAL FIELD

The present invention relates to a shoe sole and a shoe incorporating the shoe sole and, in particular, to a shoe sole including a horizontal indentation in a peripheral sidewall of the shoe sole and preferably additional structure that can be tuned to offset a wearer's side-to-side balance and thereby encourage a wearer's conditioning and toning.

BACKGROUND OF THE INVENTION

Modern athletic footwear typically include an outsole, midsole, and insole. The midsole is positioned between the ground-contacting outsole and the insole and typically includes one or more foams for attenuating impact forces generated upon the contact of a wearer's shoe on the ground. Foams such as ethelene vinyl acetate (EVA) also have resilience for energy return and are typically included in the midsole of modern athletic footwear. Athletic shoes can also include additional elements in portions of the midsole to impart a desired balance of shock-absorption (cushioning), energy return, and stability to various the user.

For example, U.S. Pat. No. 6,789,332 to Scholz discloses an L-shaped spring element attached to a top support plate. The spring element encompasses a damping element from the side and from below. The L-shaped spring, which enhances energy return, contacts the ground from below and is deflected upward, simultaneously with the damping element positioned above it, on ground contact of the sole. A downward directed restoring force is produced when the foot pushes off the ground. Overpronation or oversupination can be selectively minimized by using a less soft material for the damping material, thereby adding stability to the medial or lateral side respectively.

U.S. Pat. No. 6,216,365 to Cohen discloses a shock-absorbing unit with an effective heel member having a spine portion and elastically deformable flat spring elements branching out from the spine and rising upward to contact a top plate. A second effective member can be positioned with its spine below and contacting the first spine, with elastically deformable flat spring elements branching out and downward to contact a heel plate. A foam pad is positioned between each spine and adjacent plate. The shock-absorbing unit can be designed for specific athletic activities or for therapeutic purposes by modifying the stiffness of one or more spring elements.

U.S. Pat. No. 5,185,943 to Tong et al. discloses a resilient insert member to enhance energy return which can be positioned sandwiched between an outsole and midsole, or encapsulated in the midsole or outsole. The insert member has a central body portion and extensions which extend outwardly and downwardly from the central body portion. The extensions move outward as forces impinge on the sole, and act as a spring to return the sole to its original shape. The insert member may be "tuned" by adding apertures to those extension members located in specific areas of the sole where additional flexibility is desired and building up those extension members where it is desirable for the extension member to be more rigid or less compressible.

U.S. Pat. No. 7,421,805 to Geer discloses a support structure for a shoe that includes an elongated member that extends along the length of the shoe and a number of lateral members that extend perpendicularly from the elongated member. The lateral members may extend in an upward or downward direction or may remain in a horizontal plane.

While athletic shoes are usually designed with stability in mind, some prior art shoes are intentionally designed to promote a lengthwise instability. For example, "EasyTone" is a shoe sold by Reebok International, Ltd. that is intended to create a natural instability and a feeling akin to walking on a sandy beach. This is achieved by inserting balance pods under the heel and forefoot of the shoes. Air travels between the forefoot and heel pod to create soft cushioning. The moving air creates a natural instability and forces your muscles to adapt to the air volume within the pods. The instability encourages toning in the hamstrings, gluteus maximus, and calves.

Another known shoe designed to promote instability is the "MBT" model sold by Masai USA Corp. This shoe uses a PU midsole which has a "balancing area" in the metatarsus region, causing a rocking motion forward and rearward of the balancing area, even when standing. Also included is a soft heel pad that is intended to mimic beach sand. This design is intended to stimulate muscle toning and to burn extra calories in that the muscles tense in reaction to the natural instability. A similar design is described in U.S. Pat. No. 6,421,935 to Bartlett.

U.S. Pat. No. 291,490 to Buch shows leaf springs mounted between an outsole and a midsole.

None of these prior art references provides a shoe sole and a shoe incorporating the shoe sole, which includes a horizontal indentation in a peripheral sidewall of the shoe sole and preferably additional structure that can be tuned to offset a wearer's side-to-side balance and thereby encourage a wearer's conditioning and toning.

SUMMARY OF THE INVENTION

The present invention relates to a shoe sole and a shoe incorporating the shoe sole that can be tuned to offset a wearer's side-to-side balance and thereby encourage a wearer's conditioning and toning. The present inventions further relates to a shoe sole and a shoe with additional structures that can be used to additionally affect a wearer's balance and to tune stability, energy return and cushioning.

The present invention relates to a shoe sole which includes a midsole including an upper surface that has a width that underlies and supports a wearer's foot. The midsole also includes an upper midsole portion and a lower midsole portion adjacent and below the upper midsole portion in at least a heel portion, and a lower surface. A peripheral sidewall of the midsole extends between the upper surface and the lower surface. The upper midsole portion is undercut at least at its heel portion to define a horizontal indentation. The horizontal indentation has a depth in the peripheral sidewall along the medial and lateral sides of the midsole and a rear of the heel portion of the midsole. A balancing portion extends between the horizontal indentation on the medial and lateral sides of the indentation. The peripheral sidewall includes an upper peripheral sidewall angled upward from the horizontal indentation toward the upper surface and a lower peripheral sidewall angled downward from the horizontal indentation toward the lower surface to form a peripheral gap that widens in a direction away from a center of the shoe sole. The balancing portion has a width less than the width of the upper surface of the midsole. The midsole is adapted to upset a wearer's balance transversely to a longitudinal axis of the shoe sole, thereby forcing a wearer of the article of footwear to adjust one's walking gait to maintain a center of pressure over the balancing portion.

The upper and lower midsole portions can be separate upper and lower midsole layers or can be formed as one unitary piece.

In one aspect, the shoe sole can also include a structure disposed on the peripheral sidewall along at least one of the medial and lateral side of the shoe sole. The structure includes a base portion positioned along the horizontal indentation and a first plurality of upper extensions. The upper extensions are preferably spaced apart along the upper peripheral sidewall and extend outwardly from the base portion toward the upper surface.

The structure can additionally, or alternatively, include a second plurality of lower extensions. The lower extensions are preferably spaced apart along the lower peripheral portion and extend outwardly from the base portion toward the lower surface. The first plurality of upper extensions is preferably staggered with the second plurality of lower extensions such that the upper extensions are arranged in an alternating pattern with the lower extensions along the base portion.

Any variation of this structure with upper and/or lower extensions can be positioned along either a medial or lateral side of a shoe sole, or as a U-shaped structure, around the rearmost part of a heel portion and along both medial and lateral sides of a shoe sole. These structures can be external, in that except for an optional anchoring tab that can extend inward from the structure between an upper and lower midsole layer, they are adapted to be mounted to the peripheral sidewall. In one aspect, any of the structures having upper and/or lower extensions without a central portion can be mounted to the peripheral sidewall of an upper and lower midsole portion formed as one unitary piece.

The depth of the horizontal indentation can vary along the length of the shoe sole and from side to side, and can also extend into the midfoot and into one or both sides of a forefoot. In one preferred example of a shoe sole formed in accordance with the present invention, the depth of the horizontal indentation is deeper on the medial side than on the lateral side in the forefoot and is deeper on the lateral side than on the medial side in the heel portion.

The present invention also relates to a shoe sole which includes any of the midsoles of the present invention in combination with an outsole. In one aspect, the outsole preferably has a lower surface that includes a raised portion having a width less than the width of the upper surface of the midsole. The raised portion is adapted to promote instability in a wearer's walking gait. The raised portion protrudes generally from the center of the outsole at least in the heel portion. Preferably, a height of the raised portion increases in a direction from a forefoot portion of the shoe sole toward the rear of the heel portion of the shoe sole. A width of the raised portion in another aspect is less than two-thirds the width of the outsole.

In a different aspect, at least a portion of an outsole of the shoe sole of the present invention extends from the forefoot to the heel portion of the shoe sole and has a lower surface that includes curvature about an axis of the shoe sole that runs from the forefoot portion to the heel portion of the shoe sole. The curvature results in the outsole having a downward protruding portion for engaging the ground prior to adjacent portions of the outsole.

The present invention additionally relates to a shoe sole for an article of footwear that includes a midsole. The midsole includes an upper surface that has a width that underlies and supports a wearer's foot. The midsole also includes an upper midsole layer and a lower midsole layer disposed below the upper midsole layer in at least a heel portion, and a lower surface. The midsole has a peripheral sidewall between the upper surface and the lower surface. The upper midsole layer of at least the heel portion is undercut at its periphery to define a horizontal indentation having a depth in the peripheral sidewall of the midsole along the medial and lateral sides and a balancing portion therebetween. The peripheral sidewall includes an upper peripheral sidewall angled upward from the horizontal indentation toward the upper surface and a lower peripheral sidewall angled downward from the horizontal indentation toward the lower surface to form a peripheral gap that widens in a direction away from a center of the shoe sole. The balancing portion has a width less than the width of the upper midsole layer. The midsole is preferably adapted to upset a wearer's balance transversely to a longitudinal axis of the shoe sole, thereby forcing a wearer of the article of footwear to adjust one's walking gait to maintain a center of pressure over the balancing portion.

This shoe sole also includes a structure disposed on the peripheral sidewall along the medial and lateral side of the shoe sole. The structure includes a base portion positioned along the horizontal indentation and a first plurality of lower extensions. The lower extensions are preferably spaced apart along the lower peripheral portion on each of the medial and lateral sides, and extend outwardly from the base portion and toward the lower surface. The structure also preferably includes a second plurality of upper extensions. The upper extensions are spaced apart along the upper peripheral sidewall on each of the medial and lateral sides and extend outwardly from the base portion and toward the upper surface. The structure also includes a central portion disposed between the upper midsole layer and the lower midsole layer which includes a plurality of concavely curved leaf springs formed substantially transverse to a longitudinal axis of the shoe sole. Each concavely curved leaf spring is formed in one continuous upward arc from and with a laterally and medially positioned lower extension. The central portion also preferably includes a plurality of convexly curved leaf springs formed substantially transverse to a longitudinal axis of the shoe sole. Each convexly curved leaf spring is formed in a continuous downward arc from and with a laterally and medially positioned upper extension. The second plurality of upper extensions is preferably staggered with the first plurality of lower extensions such that the upper extensions are arranged in an alternating pattern with the lower extensions along the base portion and the integrally formed plurality of concavely curved leaf springs is staggered with the plurality of convexly curved leaf springs such that the concavely curved leaf springs are arranged in an alternating pattern with the convexly curved leaf springs. The height of the concavely curved leaf springs can be greater than the height of the convexly curved leaf springs.

In other aspects, this shoe sole can additionally include any of the outsoles of the present invention.

The present invention further relates to a shoe sole for an article of footwear that includes a midsole having an upper surface that has a width that underlies and supports a wearer's foot, a lower surface, and a structure also disposed between the upper and lower midsole layer. The structure includes a base portion and a central portion. The base portion has a medial portion on a medial side of the shoe sole and a lateral portion on a lateral side of the shoe sole. The central portion, which is disposed between the medial and lateral base portions, includes a plurality of concavely curved leaf springs.

Each of the concavely curved leaf springs is formed in a continuous upward arc toward a center of the shoe sole from transversely opposed portions of the base portion located on the lateral and medial sides of the shoe sole. The central portion also includes a plurality of convexly curved leaf springs. Each of the convexly curved leaf springs is formed in a continuous downward arc from transversely opposed portions of the base portion located on the lateral and medial sides of the shoe sole.

In one aspect, the concavely curved leaf springs are arranged in an alternating pattern with the convexly curved leaf springs. In another aspect, the midsole also includes an upper midsole layer and a lower midsole layer. The upper midsole layer includes recesses in its lower surface for receiving the concavely curved leaf springs and the lower midsole layer includes recesses in its upper surface for receiving the convexly curved leaf springs. In this way, the lower midsole layer can form a gasket to fill the spaces between the lower midsole surface and the leaf springs.

The present invention still further relates to a shoe sole for an article of footwear that includes a midsole having an upper surface that has a width that underlies and supports a wearer's foot. The midsole also includes an upper midsole layer and a lower midsole layer disposed below the upper midsole layer in at least a heel portion, and a lower surface. A peripheral sidewall extends between the upper surface and the lower surface. The upper midsole layer of at least the heel portion is undercut at its periphery to define a horizontal indentation having a depth in the peripheral sidewall of the midsole along the medial and lateral side and a balancing portion therebetween. The peripheral sidewall includes an upper peripheral sidewall angled upward from the horizontal indentation toward the upper surface and a lower peripheral sidewall angled downward from the horizontal indentation toward the lower surface to form a peripheral gap that widens in a direction away from a center of the shoe sole. The balancing portion has a width less than the width of the upper midsole layer. The midsole is preferably adapted to upset a wearer's balance transversely to a longitudinal axis of the shoe sole, thereby forcing a wearer of the article of footwear to adjust one's walking gait to maintain a center of pressure over the balancing portion.

This shoe sole also preferably includes a structure disposed on the peripheral sidewall along the medial and lateral side of the shoe sole. The structure includes a base portion positioned along the horizontal indentation and a first plurality of lower extensions. The lower extensions are preferably spaced apart along the lower peripheral portion on each of the medial and lateral side. The lower extensions extend outwardly from the base portion and toward the lower surface. The structure also preferably includes a central portion disposed between the upper midsole layer and the lower midsole layer. The central portion includes a plurality of concavely curved leaf springs. Each of the concavely curved leaf springs is preferably formed in a continuous arc upward from one of the lower extensions on the lateral side and one of the lower extensions on the medial side.

In another aspect, the shoe sole can also include a second plurality of upper extensions extending outwardly along said peripheral sidewall toward the upper surface, and a plurality of convexly curved leaf springs formed in a continuous arc downward from the upper extensions located on the medial and lateral side. In a preferred embodiment, a height of at least one of the concavely curved leaf springs is greater than a height of at least one of the convexly curved leaf springs.

Additional features of the shoe sole element of the present invention will be evident from the drawings and description provided below. Although these illustrative embodiments of the present invention have been described herein with reference to the accompanying drawings, it is to be understood that the invention is not limited to those precise embodiments, and that various other changes and modifications may be applied therein by one skilled in the art without departing from the scope or spirit of the invention.

DETAILED DESCRIPTION OF THE EMBODIMENTS

A shoe sole of the present invention has a medial side or portion, a lateral side or portion, and a forefoot, midfoot, and heel or rearfoot portion as those terms are commonly known.

The present invention, which provides a shoe sole for an article of footwear and an article of footwear which includes a deep horizontal indentation in a peripheral sidewall of at least a heel portion of the shoe sole and preferably additional structure that can be tuned to encourage a wearer's conditioning and toning, can be better understood from the following description of preferred embodiments, taken in conjunction with the accompanying drawings. It should be apparent to those skilled in the art that the described embodiments of the present invention provided herein are merely exemplary and illustrative and not limiting. All features disclosed in the description may be replaced by alternative features serving the same or similar purpose, unless expressly stated otherwise. Therefore, numerous other embodiments of the modifications thereof are contemplated as falling within the scope of the present invention and equivalents thereto.

The present invention relates to a shoe sole that can be selectively tuned to provide a desired amount of cushioning, energy return, and stability or instability to targeted portions of a shoe sole. The shoe soles of the present invention can be tuned to upset the side-to-side or transverse balance of a person wearing an article of footwear incorporating the shoe sole. By upsetting the wearer's balance, the shoe soles of the present invention preferably cause the wearer to work harder to maintain one's balance, in a manner akin to balancing on a balance beam or board—by adjusting one's posture to maintain one's center of weight over a central balancing portion of the shoe sole. The shoe soles thereby promote the wearer's conditioning and toning. Preferably, the shoe soles of the present invention can cause an increase in muscle activation in wearers and an increase in calorie burning compared to conventional shoe soles. Targeted muscle groups include the calf, quad, gluteus maximus and hamstring muscle groups.

Figure 1:
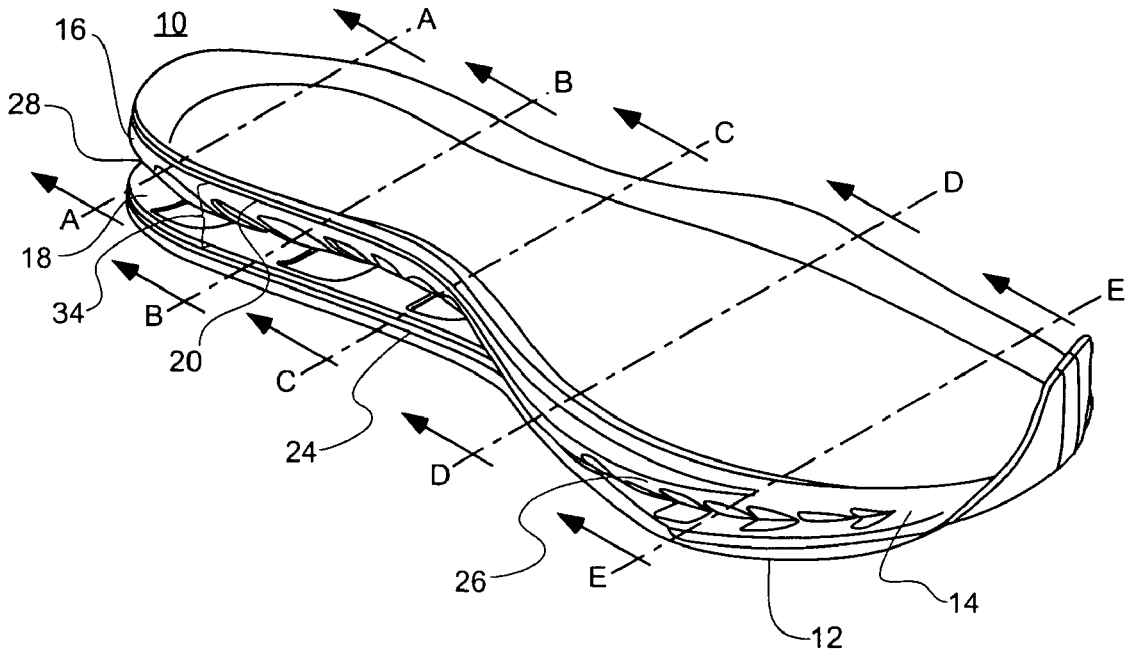
FIG. 1 is a perspective view of a shoe sole for a left shoe of the present invention.
Figure 2:
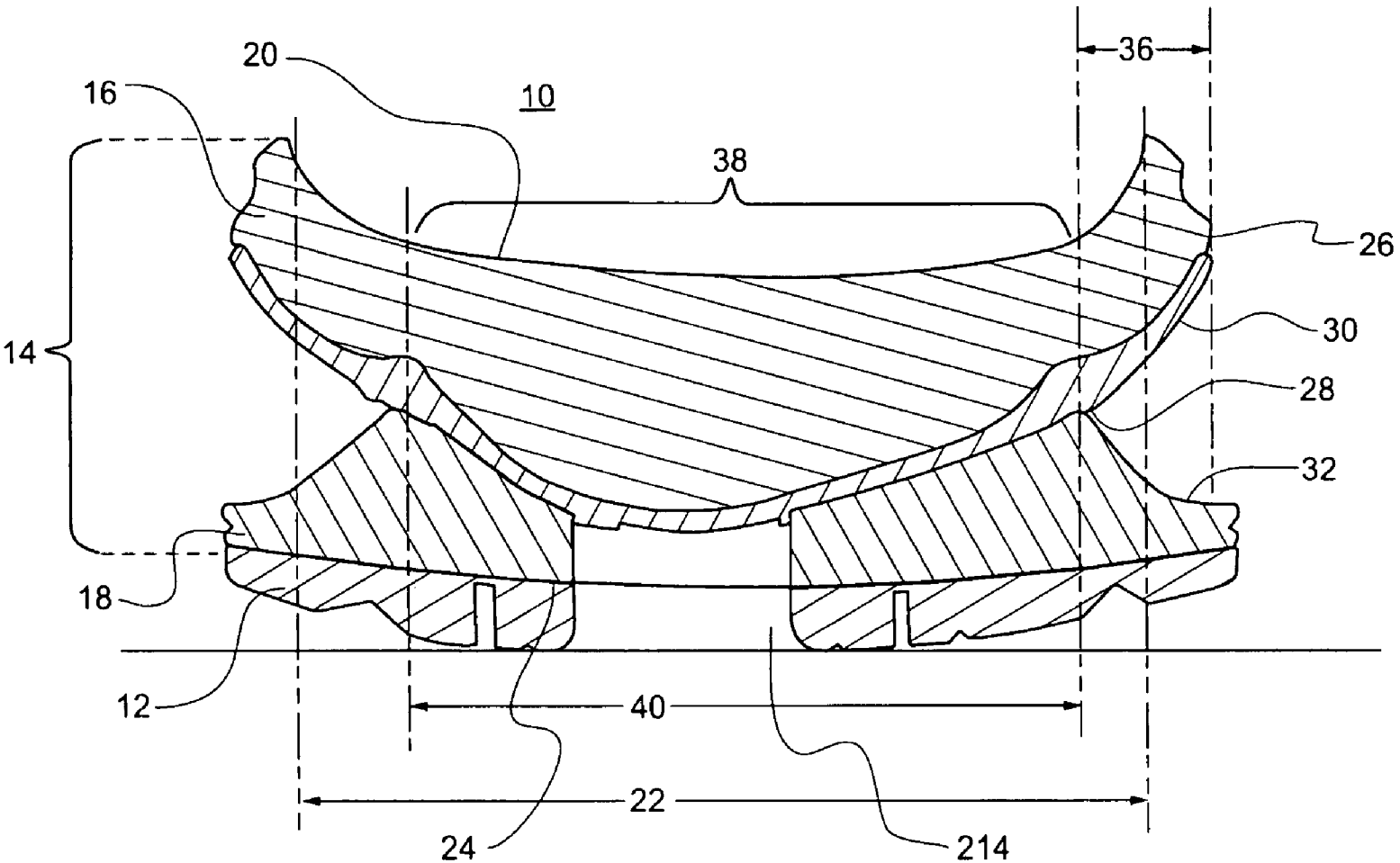
FIG. 2 is a cross-section view in the heel portion of a shoe sole of the present invention.

In a shoe sole of the present invention, as shown in the embodiment of FIG. 1, a shoe sole 10 includes a midsole 14 and may also include an outsole 12. Referring also to FIG. 2, the midsole 14 at least in a heel portion of the shoe sole 10 includes an upper midsole portion 16 and a lower midsole portion 18 that is disposed below the upper midsole portion 16. In some embodiments, the upper 16 and lower 18 midsole portions can be directly adjacent with no structure therebetween. The midsole 14 has an upper surface 20 that underlies and supports a wearer's foot. An insole (not shown) may be provided above the upper midsole portion 16.

Referring also to FIG. 2, the upper surface 20 of the midsole 14 has a width 22 that underlies the wearer's foot. For a properly fitted article of footwear, this width 22 corresponds substantially to the outermost width of the sole of a wearer's foot at a particular transverse cross-section. The lower midsole portion 18 has a lower surface 24 that is preferably disposed on and above the outsole 12, if one is provided. The midsole 14 has a peripheral sidewall portion 26 that extends along the periphery of the midsole 14 from the upper surface 20 to the lower surface 24 of the midsole 14.

In order to advantageously induce a side-to-side imbalance in a wearer of a shoe having the shoe sole 10, the upper midsole portion 16 is undercut at its periphery to create a deep horizontal indentation 28 in the peripheral sidewall 26 along at least the medial and lateral sides of the shoe sole 10 in at least the heel portion, and preferably continuously around the rear of the heel portion as well. As a result, the peripheral sidewall 26 is angled upward and outward from the horizontal indentation 28 toward the upper surface 20 of the upper midsole portion 16 to form an upper peripheral sidewall 30. A corresponding wedge-shaped gap is chiseled out of the top of the lower midsole portion 18 to form a lower peripheral sidewall 32 angled outward and downward from the horizontal indentation 28 toward the lower surface 24. A peripheral gap 34 is thus formed between the upper peripheral sidewall 30 and lower peripheral sidewall 32 that widens in a direction away from the center of the shoe sole 10.

The horizontal indentation 28 has a depth measured horizontally inward from the outer edge of the upper midsole portion 16. A narrowed balancing portion 38 in at least the heel portion of the midsole 14 is therefore formed in the region between the medial and lateral horizontal indentations 28, which defines an area over which a wearer of the shoe sole must place one's weight in order to stay balanced. By making the transverse width 40 of the balancing portion 38 less than the width 22 of the midsole 14 that underlies the wearer's foot, the wearer's side-to-side balance is upset, which forces the wearer to have to work to adjust one's gait and shift one's weight to maintain a center of pressure over the balancing portion 38. By also undercutting the midsole to extend the horizontal indentation 28 around the rear of the heel, an additional longitudinal imbalance is imparted and creates the feel of one's heel pushing into a sandy surface on heel strike.

FIG. 2 shows a cross section of the heel portion of an embodiment of the shoe sole 10 of the present invention. In this figure, the width of the portion of the upper midsole portion 16 that underlies the wearer's foot is denoted as 22. The width of the balancing portion 38 of the midsole is denoted as 40. The depth of the horizontal indentation 28 is denoted as 36. As can be seen in this figure, the width 40 is narrower than the width 22. By increasing the depth 36 of the horizontal indentation 28, the width 40 of the balancing portion 38 can be narrowed even more, thereby forcing the wearer to have to exert additional effort to maintain their balance over the balancing portion 38 of the shoe sole 10.

Various properties of the shoe sole of the present invention can be tuned to increase or decrease the degree and/or direction of instability imparted to a wearer of an article of footwear incorporating the shoe sole. Tunable properties of embodiments of the shoe sole of the present invention include the thickness and the material of the upper midsole portion and lower midsole portion, which can also be varied throughout the different regions or portions of the shoe sole (forefoot, midfoot, heel, medial, lateral portions).

For example, the lower midsole portion is preferably made of ethelene vinyl acetate (EVA) foam, polyurethane (PU) foam or foam blends or any other suitable materials can be used as well. Its density and other properties can be varied to change the amount of cushioning and shock absorption that it provides. The upper midsole portion is also preferably made of ethelene vinyl acetate (EVA) foam, polyurethane (PU) foam or foam blends or any other suitable materials can be used as well. Its density and other properties can be varied to change the amount of cushioning and shock absorption that it provides. In one embodiment, the upper and lower midsole portions are separate upper and lower midsole layers that can be formed of materials of differing densities and/or materials.

For example, the upper midsole portion 16 of FIG. 1 can be a layer of material that is less dense or softer than the lower midsole portion 18 in order to provide additional cushioning directly beneath the foot. In another embodiment, the upper midsole portion 16 is more dense or stiffer than said lower midsole portion 18.

The upper and/or lower midsole portion in various embodiments can also be thicker in the rearfoot portion in order to provide more cushioning in that region, and/or to provide heel lift.

In another embodiment, the upper midsole portion 16 and lower midsole portion 18 are formed as a single unitary piece over the length of the shoe sole 10.

In yet another embodiment of the shoe sole 10, the upper 16 and lower 18 midsole portions in at least the heel are formed from different midsole layers, and the lower midsole portion extends only over a heel, or optionally also over at least a midfoot portion of the shoe sole, but not into the forefoot. In contrast, the upper midsole portion extends from the heel portion into the midfoot and forefoot portions, where the entire thickness of the midsole in the forefoot portion is integrally formed from the same material as the upper midsole portion in the heel.

Referring still to FIG. 2 as well as to FIG. 3A, the width 40 of the balancing portion 38 of the midsole 14 can be tuned by varying the depth 36 of the horizontal indentation 28 to promote either stability or instability in the shoe sole 10. Of course, as the indentation 28 is deepened to further narrow the balancing portion 38, the instability is increased.

Figure 3:
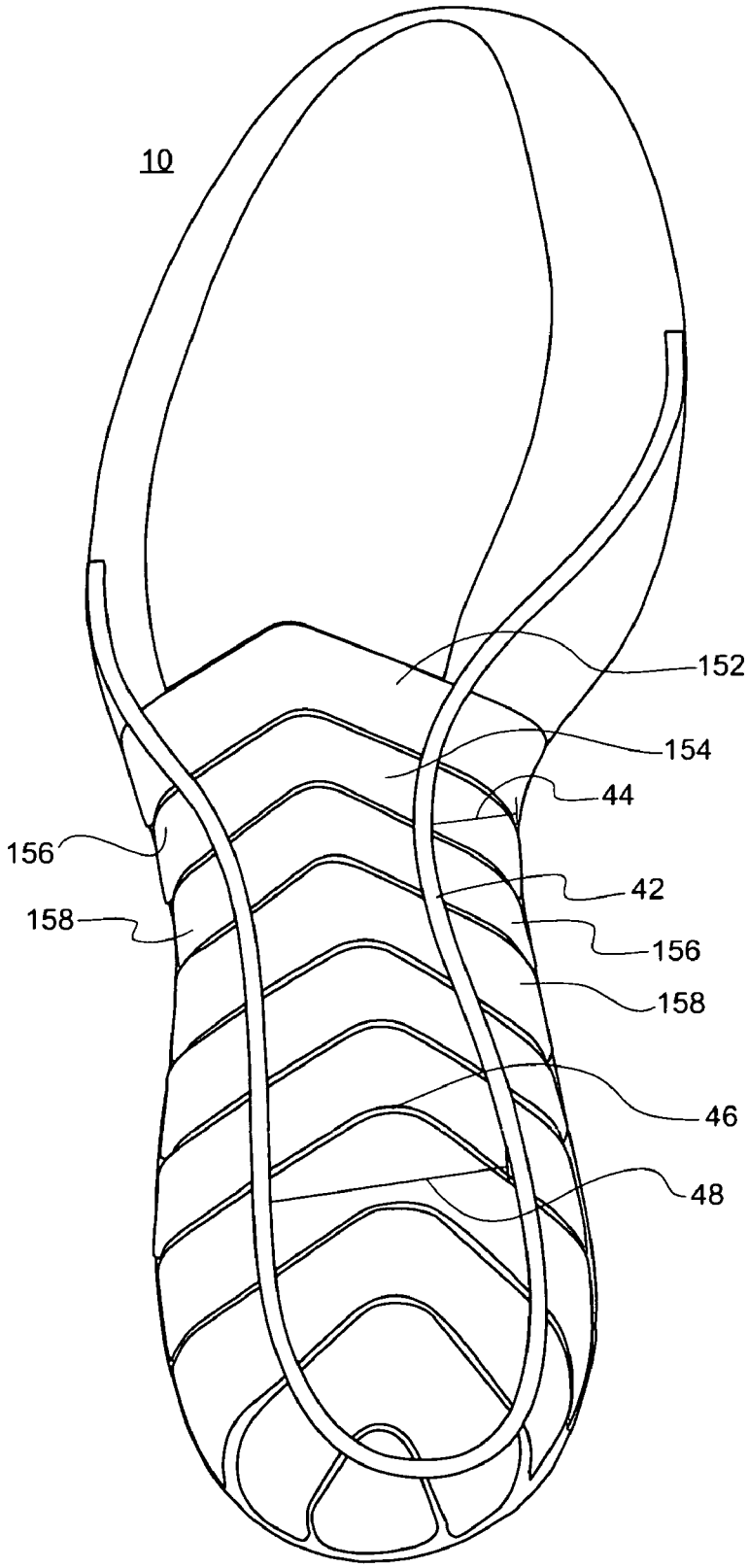
FIG. 3A is a top view of an embodiment of a structure assembled on an embodiment of a lower midsole portion of a right shoe sole of the present invention.
FIG. 3B is an outline of a top view of the right shoe sole of FIG. 3A and its corresponding left shoe sole showing a representative balancing path
Figure 3B:
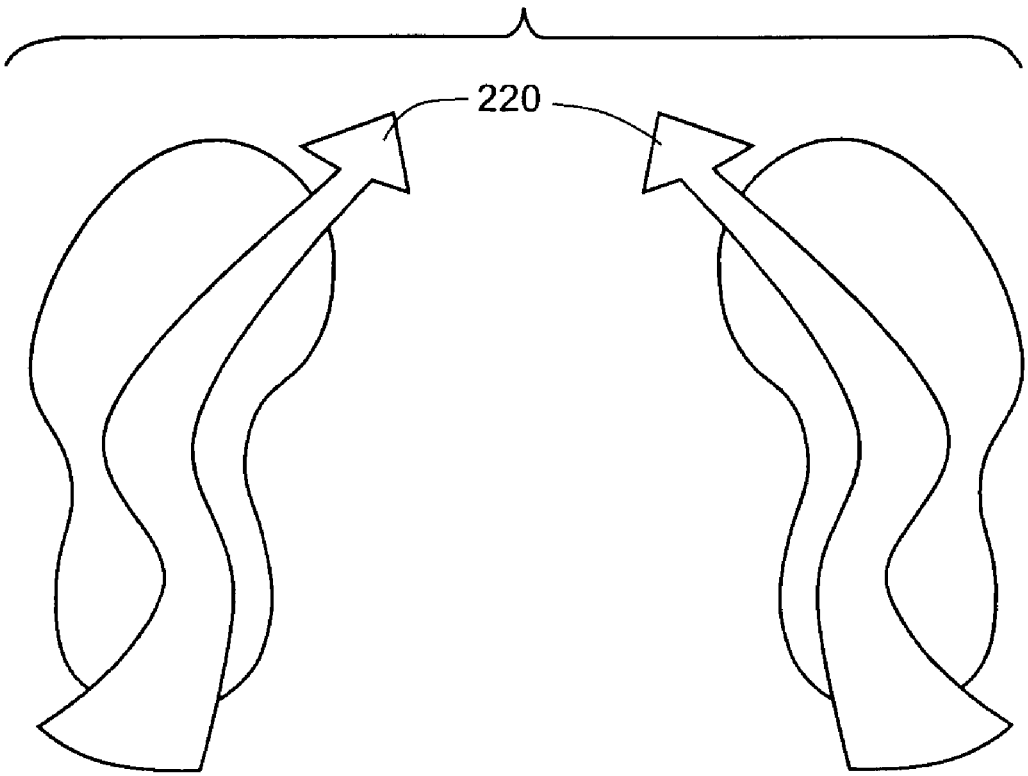

The centering of the balancing portion 38 can also be tuned by making the depth 36 of the horizontal indentation 28 deeper in some portions of a shoe sole 15 than in other portions. In this way, a "balancing path" 222, as can be seen in FIG. 3B, along a shoe sole 15 over which a wearer's weight should be centered in order to maintain one's balance can be defined and tailored to target different muscle groups of the wearer for conditioning and toning.

As shown in FIG. 3A, in one embodiment, the depth 36 of the horizontal indentation 28 is deeper on the lateral side of the heel portion of the midsole 14 than on the medial side of the heel portion of the midsole 14. By making the depth 36 of the horizontal indentation 28 deeper on the lateral side of the heel portion than on the medial side, the shoe sole 15 can force the wearer to favor balancing on the medial side of their feet.

The horizontal indentation 28 can also be extended into the midfoot along either the medial or lateral side of a shoe sole, or both, to extend the path length over which a wearer must exert extra effort to maintain balance. As shown in FIG. 3A, the depth 36 of the horizontal indentation 28 can be varied from side-to-side and from the forefoot portion of the shoe sole 15 to the rearfoot portion of the shoe sole 15, thereby creating an asymmetric and/or off-center balancing portion 38 of the shoe sole. In the embodiment shown in FIG. 3A, the depth 44 of the horizontal indentation 42 is deeper on the lateral side of the heel portion than on the medial side of the heel portion and the depth 44 of the horizontal indentation 42 gradually shifts going into the forefoot so that it is deeper on the medial side of the forefoot portion than on the lateral side of the forefoot portion. By forcing the wearer to switch back and forth between favoring the medial and lateral sides of one's feet while walking, the shoe sole 15 would cause the wearer to have to exert more energy to maintain one's balance while walking, thereby promoting conditioning and toning.

Referring again to FIG. 2, to size the balancing portion 38 appropriately so that the wearer must exert additional energy in order to maintain one's weight over the balancing portion 38, the depth 36 of the horizontal indentation 28 along a substantial portion of at least one of the medial and lateral sides of the heel portion of the shoe sole 10 is preferably at least 6% of the width 22 of the portion of the upper midsole portion 16 underlying the wearer's foot at that location. Therefore, in a preferred embodiment of a shoe sole having a horizontal indentation that wraps around the rearmost part of the heel portion and along both a medial and lateral side of the heel portion, the balancing portion 38 is preferably 12% narrower than the width 22 underlying a wearer's foot.

In a further embodiment, the depth 36 of the horizontal indentation 28 is at least 10% of the width 22 of the portion of the upper midsole portion 16 underlying the wearer's foot along a substantial portion of the heel portion of the shoe sole 10. In another embodiment, the depth 36 of the horizontal indentation 28 is at least 14% of the width 22 of the upper midsole portion 16 underlying the wearer's foot along a substantial portion of the heel portion of the shoe sole 10.

In yet another embodiment, the depth 36 of the horizontal indentation 28 in the heel portion is between about 10% and 20%, preferably between about 14% and 20%, of the width 22.

In still another embodiment, the depth 36 of the horizontal indentation 28 in the heel portion is between about 20% and 30% of the width 22.

In a further embodiment, the depth 36 of the horizontal indentation 28 in the heel portion is between about 30% and 40% of the width 22, and can be as much as 45%.

In embodiments including a horizontal indentation 28 that extends into the midfoot and optionally into the forefoot, the depth 36 preferably tapers continuously either from the rearmost part of the heel into the forefoot, or continuously beginning forward of the heel portion into the forefoot.

In one embodiment, a depth 36 of the horizontal indentation 28 decreases to on the order of 1% in a central portion of the forefoot portion. In other embodiments, the depth 36 of the horizontal indentation 28 decreases in a central portion of the forefoot portion by about 10% of the maximum depth in the heel portion.

The angle of the undercut and thus the height of the peripheral gap 34 at the outer perimeter of the midsole can also be tuned to affect the amount of energy that the wearer must exert while walking. By making the peripheral gap 34 larger, the shoe sole 10 will compress more easily when a wearer's weight is placed over it. In one embodiment, the height of the peripheral gap 34 at the outer perimeter of the midsole 14 in the heel portion increases to at least 35% of the thickness of the midsole 14, preferably to at least 45%. In other embodiments in which the horizontal indentation 28 extends into the midfoot and optionally the forefoot, the height of the peripheral gap 34 in the midfoot portion increases to at least 20%, preferably to at least 30% of the thickness of the midsole 14, and the height of the peripheral gap 34 in the forefoot portion increases to at least 14%, preferably to at least 24% of the thickness of the midsole 14.

Embodiments of the shoe soles of the present invention described herein can include a full length outsole layer 12, which can extend under the entire midsole or any portion thereof, or may have at least a portion that extends over the full length of the shoe sole 10. In other embodiments, selectively positioned pads or pods can be disposed below portions of the midsole 14 for contacting a ground surface. In other embodiments, the lower surface of the midsole 24 forms at least a portion of the ground-contacting surface of the shoe sole 10. The outsole 12 portions or layers can be formed of any appropriate material for contacting a walking surface.

For any of the embodiments of the shoe sole described above, a structure can be disposed along a portion, or all, of the horizontal indentation in order to provide further tenability of a hoe sole formed in accordance with the present invention.

Figure 4A:
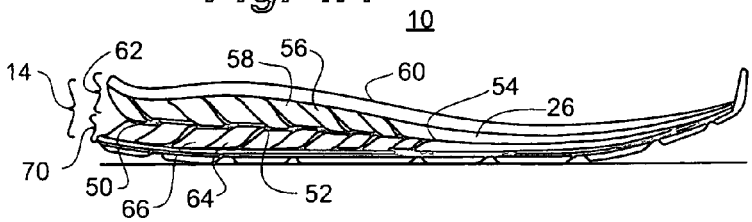
FIG. 4A is a side view of an embodiment of a shoe sole of the present invention.

A side view of an embodiment of a shoe sole 10, for example, that incorporates a tunable structure 50 is shown in FIG. 4A. The structure 50 can be disposed along the medial or lateral side of the peripheral sidewall 26 of the midsole 14, or both. In a preferred embodiment, the medial and lateral sides of the structure 50 are connected in a continuous manner around the rearmost part of the heel. One such U-shaped structure (see structure 124 of FIG. 11) can be adapted for mounting externally to a midsole 14, which is, in this embodiment, preferably formed as one unitary piece. Other structures for mounting externally, preferably to a midsole 14 having the upper 16 and lower 18 midsole portions formed as one unitary piece, can extend along only one of a medial or lateral side (see structure 112 of FIG. 7).

The structure 50 includes a base portion 52 positioned along the horizontal indentation 54 and a first plurality of upper extensions 56. The upper extensions 56 are spaced out along the upper peripheral sidewall 58 and extend outwardly and upwardly from the base portion 52 toward the upper surface 60 of the upper midsole portion 62. In one embodiment, the upper peripheral sidewall 58 may have indentations formed in it to accept the upper extensions 56, so that the extensions are substantially flush with the surface of the sidewall 58. In a further embodiment of the structure 50 disposed along the horizontal indentation 54, as shown in FIG. 4A, the structure 50 also includes a second plurality of lower extensions 64. The lower extensions 64 are spaced apart along the lower peripheral sidewall 66 and extend outwardly and downwardly from the base portion 52 toward the lower surface 68 of the lower midsole portion 70. In one embodiment, the lower peripheral sidewall 70 may have indentations formed in it to accept the lower extensions 64. In one embodiment, the upper extensions 56 and lower extensions 64 are staggered in an alternating pattern along the base portion 52 of the structure 50. During foot strike, the impact of a shoe sole formed in accordance with the present invention between the foot and the ground will push the upper extensions 56 downward and outward. The lower extensions 64 will be pushed upward and outward. When the foot lifts away from the ground, the upper extensions 56 and lower extensions 64 will return to their resting shapes. Through this action, the upper extensions 56 and lower extensions 64 can be used to absorb energy from the foot strike. In particular, the upper extensions 56 can lend targeted support to different areas of the shoe sole 10, for example, which due to the undercut, will be extremely pliable and subject to collapse. The lower extensions 64 can be tuned to contribute to rebound energy in selected areas of the sole 10.

Figure 4B:
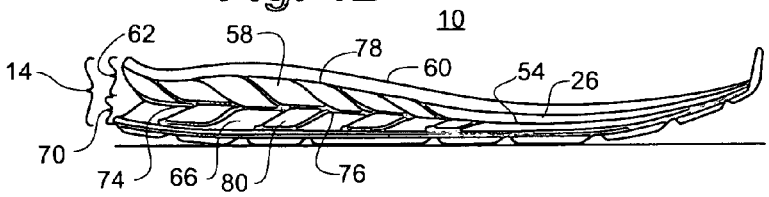
FIG. 4B is a side view of an embodiment of a shoe sole of the present invention.
Figure 4C:
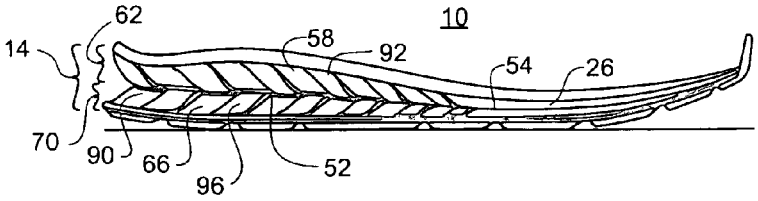
FIG. 4C a side view of an embodiment of a shoe sole of the present invention.
Figure 4D:
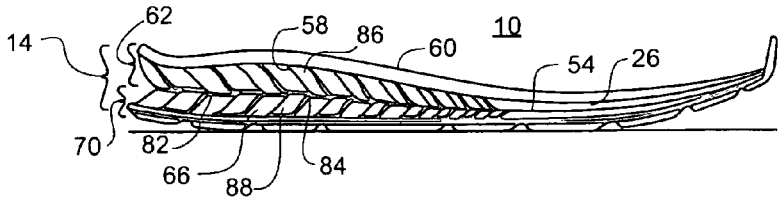
FIG. 4D a side view of an embodiment of a shoe sole of the present invention.

The tunable properties of the upper extensions 56 and lower extensions 64 include their stiffness, size, spacing and placement. The upper 56 and lower 64 extensions can be made stiffer in one region or along the entirety of the structure in order to provide more stability and more rebound capability, respectively, in that area. Alternatively, the upper 56 and lower 64 extensions can be made less stiff to provide less stability and rebound respectively in an area. The size of the upper extensions 56 and lower extensions 64 can also be tuned. For example, FIG. 4B shows a structure 74 with larger upper extensions 78 and lower extensions 80, which results in fewer extensions 78 and 80 being used along the structure 74. Alternatively, FIG. 4D shows a structure 82 with smaller upper extensions 86 and lower extensions 88, which results in more extensions 86 and 88 being used along the structure 82. By changing the size of the extensions 86 and 88, the structure 82 can also be tuned to vary both the transverse and longitudinal stability and pliability of a shoe sole of the present invention.

In one embodiment, the length of the structure 50, 74 is restricted to the heel portion as shown in FIGS. 4A and 4B, which leaves greater longitudinal flexibility in the midfoot and forefoot areas. In another embodiment shown in FIGS. 4C and 4D, a structure 82, 90 extends further into the midfoot area of the shoe sole 10. The longer structure 82, 90 provides additional support and/or rebound energy in the midfoot or, in certain embodiments, into a forefoot portion of the shoe sole 10.

Figure 5:
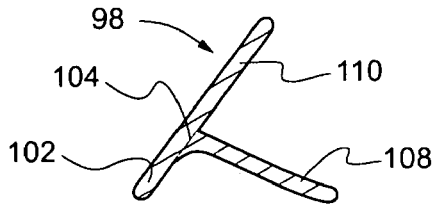
FIG. 5 is an overlay of two cross-sectional views of an embodiment of a structure of the present invention.
Figure 6A:
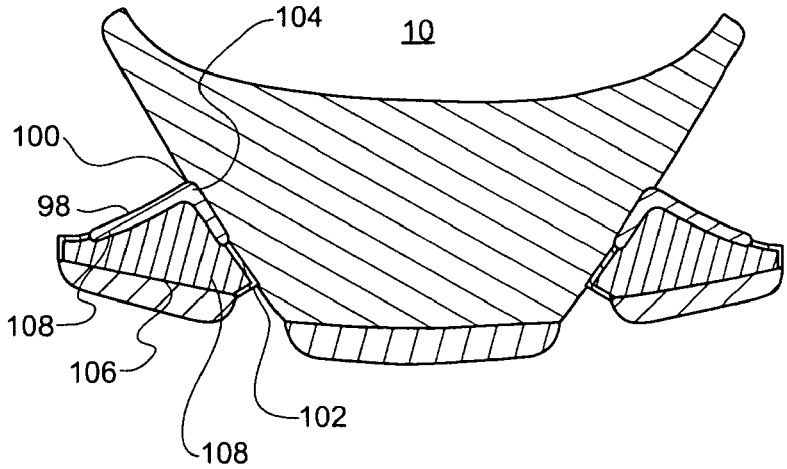
FIGS. 6A and 6B are cross-section views of an embodiment of a shoe sole of the present invention.
Figure 6B:
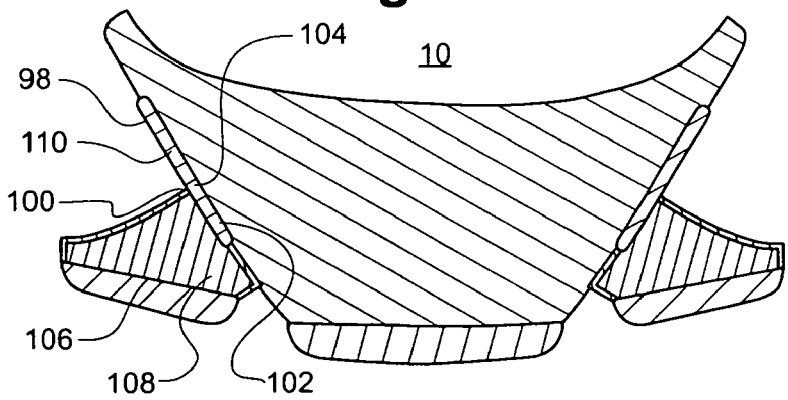

In one embodiment of a structure 98 disposed in a horizontal indentation 100, as shown in FIG. 5, the structure 98 also has an anchoring tab 102 that extends inwardly from the base portion 104 and toward the lower surface 106 of the lower midsole portion 108. The anchoring tab 102 is most preferably used to anchor a structure 98 of the present invention to a midsole 14 in which the upper 16 and lower 18 midsole portions are formed from separate upper and lower midsole layers. The anchoring tab 102 can be used to help fix the structure 98 along the horizontal indentation 100. Cross sections of a shoe sole of the present invention with the structure 98 incorporating an embodiment of the anchoring tab 102 are shown in FIGS. 6A and 6B. As can be seen, the anchoring tab 102 of the present invention can extend downward from at least one lower extension 108 as shown in FIG. 6A or downward as a continuous extension from at least one upper extension 110 as shown in FIG. 6B. In another embodiment, the anchoring tab 102 can also be one continuous piece that extends downwardly from both the upper extensions 106 and lower extensions 108 along the base portion 104.

Figure 7:
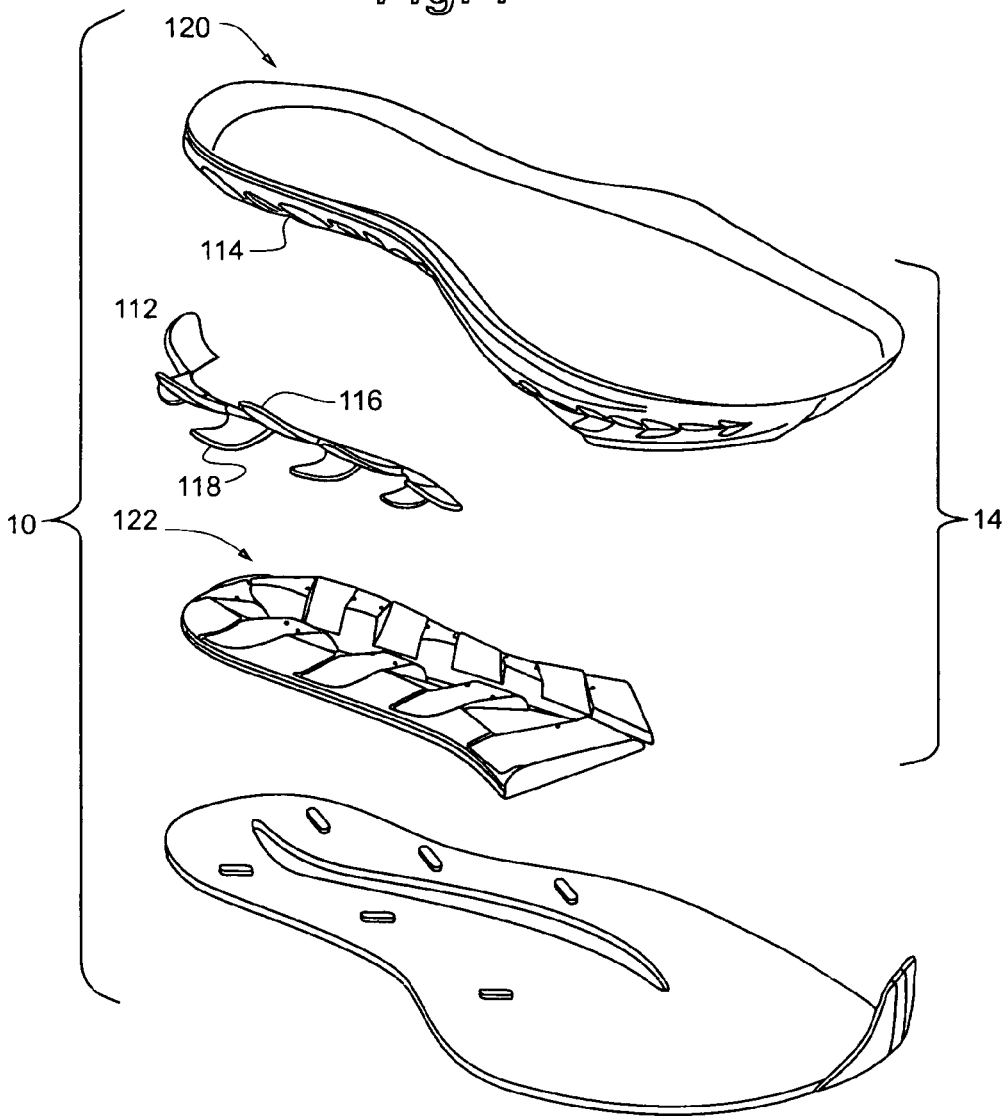
FIG. 7 is an exploded view of an embodiment of a shoe sole for a left shoe of the present invention.

FIG. 7 shows an exploded view of one embodiment 25 of the present invention in which a structure 112 is disposed in the horizontal indentation 114 formed between an upper 120 and lower 122 midsole layer upon assembly. In the embodiment shown, the structure 112 is disposed along at least a substantial portion of either the medial or lateral side of the heel portion of the midsole 14. The structure 112 includes a series of alternating upper extensions 116 and lower extensions 118 extending from a base portion 117. In assembly, the upper extensions 116 extend outward along the peripheral sidewall from the horizontal indentation 114 in the direction of the upper midsole portion 120. The lower extensions 118 extend outward from the horizontal indentation 114 and in the direction of the lower midsole portion 122. In one embodiment, the upper midsole layer 120 and lower midsole layer 122 have recesses shaped to accommodate the upper extensions 116 and lower extensions 118. The lower midsole layer 122 can be designed to further enhance rebounding action in cooperation with the structure 112.

Figure 8:
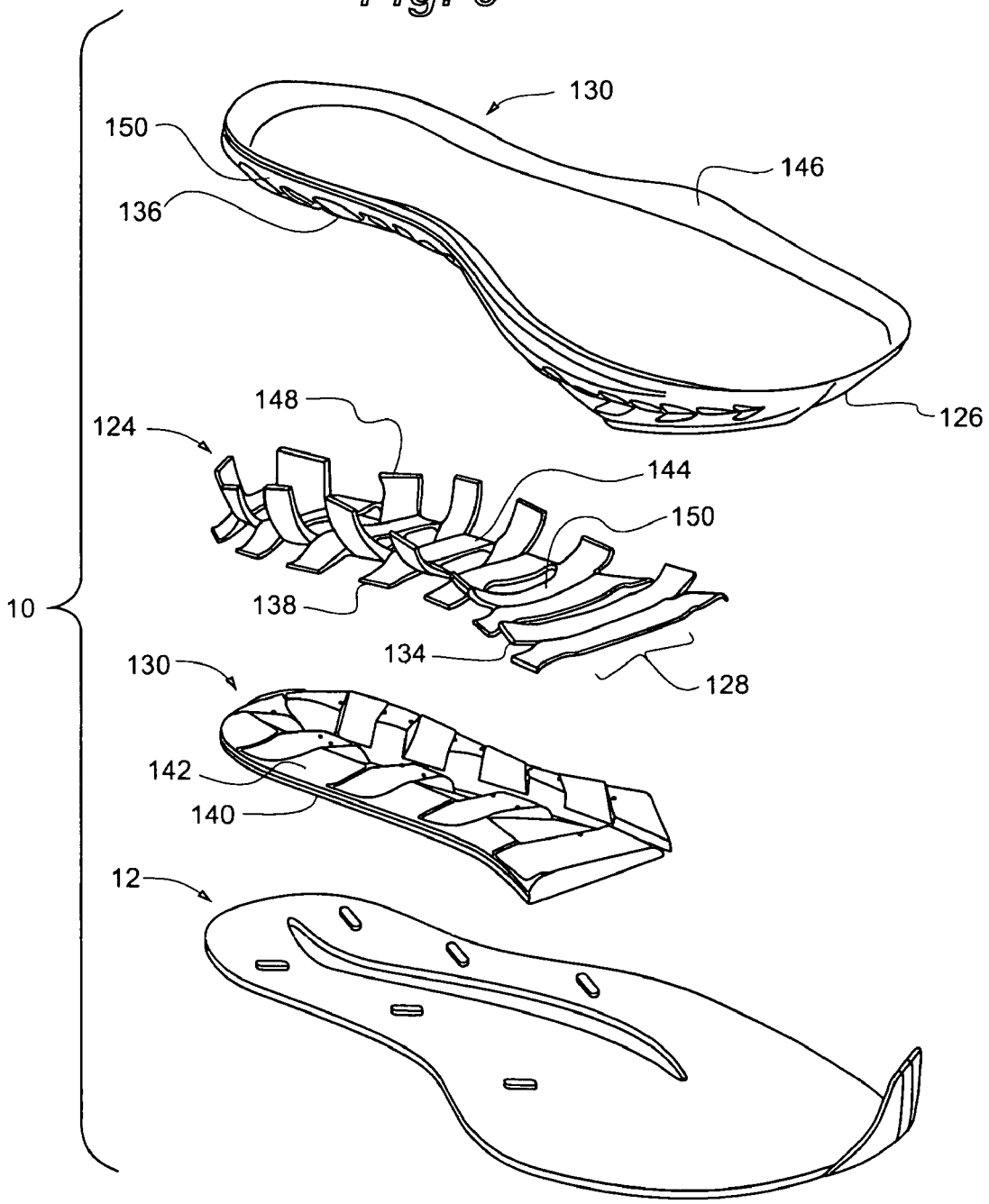
FIG. 8 is an exploded view of an embodiment of a shoe sole with a structure for a left shoe of the present invention.

Referring to FIG. 8, in another embodiment 35 of a structure 124 of the present invention, the structure 124 includes a central portion 128 between a medial and lateral side of the shoe sole, preferably disposed between an upper midsole layer 130 and a lower midsole layer 132. The central portion 128 includes a plurality of concavely curved leaf springs 144 extending from the medial and lateral sides, preferably from a base portion 134. The concavely curved leaf springs 144 arc upward toward a central portion of the shoe sole and toward the upper surface 146 of the upper midsole portion 130 from a portion of the base portion 134 positioned on the medial side of peripheral sidewall 126 and then downward to the portion of the base portion 134 positioned on the lateral side of peripheral sidewall 126. Preferably, one continuous arc is formed.

As shown in FIG. 8, the central portion 128 of the structure 124 further, or optionally, includes a plurality of convexly curved leaf springs 150 that are formed extending from the medial and lateral sides. preferably from the base portion 134. The convexly curved leaf springs 150 arc downward from the medially positioned base portion 134 toward the lower surface 140 toward a center of the shoe sole and then upward to the base portion 134 on the lateral side of the peripheral sidewall 126. The convexly curved leaf springs 150 and concavely curved leaf springs 144 are preferably arranged in an alternating pattern and are preferably oriented perpendicular to a foot's natural walking strike path, allowing for optimal cushioning centered along the walking strike path.

Though the base portion is preferably provided in order to form one structure 124 that can be easily mounted in a shoe sole, it is also within the scope of the invention to provide continuously arced leaf springs through the midsole that are not interconnected through a base portion.

In a preferred embodiment, the height of the concavely curved leaf springs 144 is greater than the height of convexly curved leaf springs 150.

In additional embodiments, the structure 132 further includes upper extensions 148 on the medial and lateral upper peripheral sidewalls 151 and/or lower extensions 138 on the medial and lateral lower peripheral sidewalls 142.

Each concavely curved leaf spring 144 is preferably formed continuously with one lower extension 138 on the lateral lower peripheral sidewall 142 and one lower extension 138 on the medial lower peripheral sidewall 142. Each convexly curved leaf spring 150 is preferably formed continuously with one upper extension 148 on the lateral upper peripheral sidewall 151 and one upper extension 148 on the medial upper peripheral sidewall 151.

As can be seen in FIG. 8, the concavely curved leaf springs 144 are preferably arranged in an alternating pattern with the convexly curved leaf springs 150. In an alternative embodiment, as shown in FIG. 3, multiple leaf springs 152, 154 may be formed continuously with a single upper 156 and/or lower extension 158 on either the medial or lateral side of the midsole 48, or both.

In one embodiment, the entire structure 124 can be formed of any one suitable material such as thermoplastic polyurethane (TPU) and can be integrally molded. In other embodiments, any one or more elements or type of elements (concave leaf springs 144, convex leaf springs 150, upward extensions 148, downward extensions 138), for example, in a particular location of the shoe sole 10 can be formed of a material independently selected from the following exemplary materials bearing in mind that other suitable materials are also contemplated: thermoplastic polyurethane (TPU), polyester-TPU, polyether-TPU, polyester-polyether TPU, polyvinylchloride, polyester, thermoplastic ethyl vinyl acetate, styrene butadiene styrene, polyether block amide available under the trademark Pebax®, engineered polyester available under the trademark Hytrel®, TPU blends including natural and synthetic rubbers, and blends or combinations thereof. The hardness of the material suitable for the elements of the structure can range from as low as about 25 Shore A to about 70 Shore D, depending on the desired result. The performance properties of the midsole 14 can be adjusted by changing the hardness of the structure 124. For example, it is contemplated using a more compliant material for the lateral side of the structure 124 and another stiffer material for the medial side. It is also contemplated to use a softer material for the concave springs 144 and upper extensions 148 than for the convex springs 150 and lower extensions 138. However, any combination of stiffness of the various elements and midsole layers of the shoe sole 10 is within the scope of the invention.

In any of the embodiments of a structure including a central portion, either or both of the surfaces of the upper and lower midsole layers adjacent the leaf springs can be formed with recesses shaped to accommodate the curvatures of the leaf springs. In this way, the lower midsole layer 132, for example, can form a gasket between an outsole 12 or between a lower surface of a midsole 14 and the leaf springs of central portion 128, preventing any grit or moisture from penetrating through the structure 124. The use of these recessed surfaces in the midsole layers allows continuously curved leaf springs, concave and/or convex, to be easily assembled into the midsole of a shoe sole of the present invention, as well as to be protected from too much exposure to the dirt and moisture of the environment. This construction also allows differing thicknesses of the different midsole layers, as they are aligned with the curved springs, to be placed longitudinally through the shoe sole. Therefore, both the curvature of the springs and the thicknesses of the two midsole layers can vary over the length of the shoe sole (see FIG. 9, for example).

Like the upper and lower midsole portions and upper and lower extensions, the properties of the convexly curved leaf springs 150 and the concavely 144 curved leaf springs in different areas, such as size, thickness, stiffness, spacing and curvature, can be varied in order to finely tune the cushioning, energy return, and stabilization properties of the shoe sole 10. The concavely curved leaf springs 144 can be made softer, for example, to increase cushioning, or harder to increase energy return. Likewise, the convexly curved leaf springs 150 can be made softer to promote instability around the foot's natural walking strike path, or harder to increase stability. In one embodiment, it is desirable to increase the softness of the convexly curved leaf springs 150 to promote a small amount of instability. A more unstable shoe sole causes a wearer to have to work harder to maintain normal pressure in the center of their strike path. Instability in the shoe sole can therefore be used to promote fitness and toning in the wearer's lower extremities. Likewise, in such a shoe sole it may be desirable to increase the softness of the concavely curved leaf springs 144, particularly in the heel, to provide a feeling akin to walking on a sandy beach. The degree of softness of the various concavely curved leaf springs 144 and convexly curved leaf springs 150 can be varied depending on the desired effect. Alternatively, proper tuning of both the convexly curved 150 and concavely curved 144 leaf springs can be used to promote stability at various areas of the shoe sole 10 for particular athletic activities.

Figure 9:
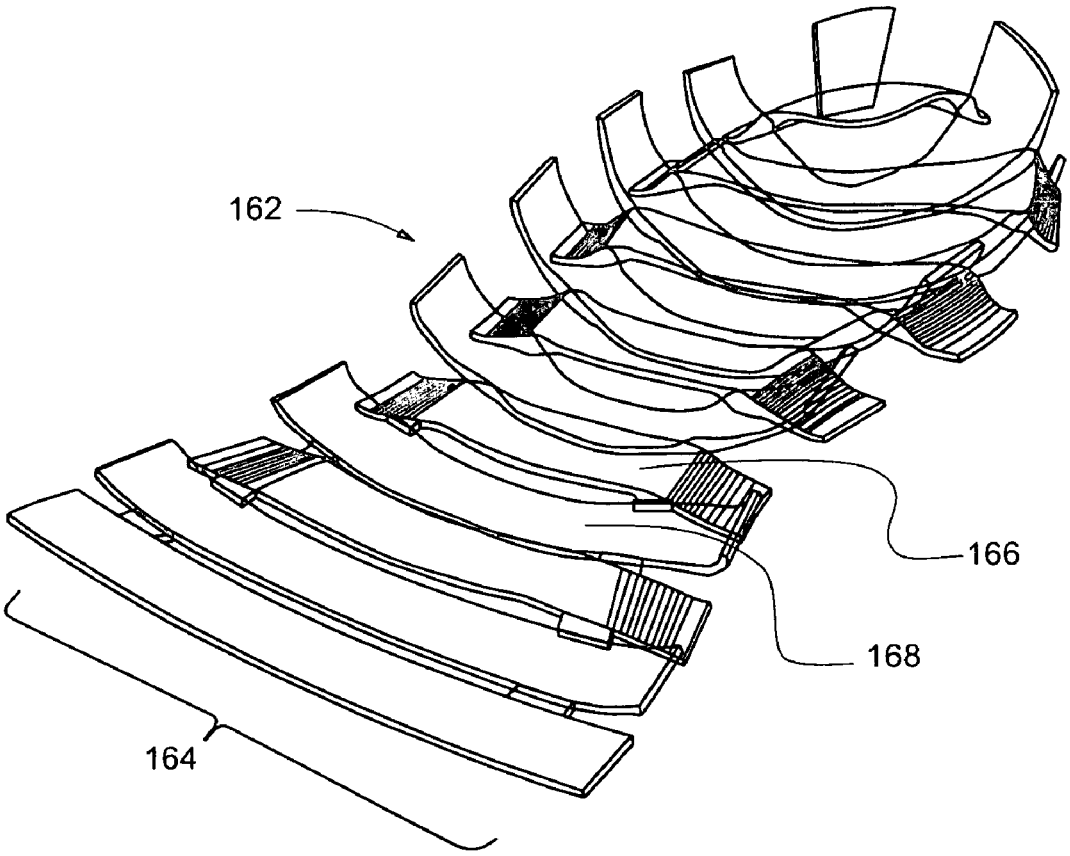
FIG. 9 is a perspective view of an embodiment of a structure with central leaf springs of the present invention.

Because of the discrete nature of the concavely curved leaf springs 144 and convexly curved leaf springs 150, different areas of the shoe sole 10, for example (forefoot, rearfoot, midfoot), on different sides (medial and lateral) of the shoe sole 10 can be independently stiffened or softened to create any desired balance of cushioning, energy return, and stability. FIG. 9 shows an embodiment 162 of the structure that includes a central portion 164 in which the opposing concavely curved leaf springs 166 and convexly curved leaf springs 168 are of two different stiffnesses. The different stiffnesses may be provided by using different materials, different densities of a material, different thicknesses of a material, and so on. For example, the concavely curved leaf springs 166 may be made softer to provide additional cushioning and the convexly curved leaf springs 168 may be made harder to provide additional rebound. Additionally, the stiffness of the convexly curved leaf springs 168 and concavely curved leaf springs 166 may be varied along the length of the structure 162. For example, the convexly curved leaf springs 168 in the rearfoot portion of the shoe sole may be made stiffer than the convexly curved leaf springs 168 in the forefoot portion of the shoe sole 10. Varying the stiffness of the convexly curved leaf springs 168 and concavely curved leaf springs 166 can be used to tune the cushioning, shock absorption, and stability properties of the various portions of a shoe sole formed in accordance with the present invention.

Figure 10A:
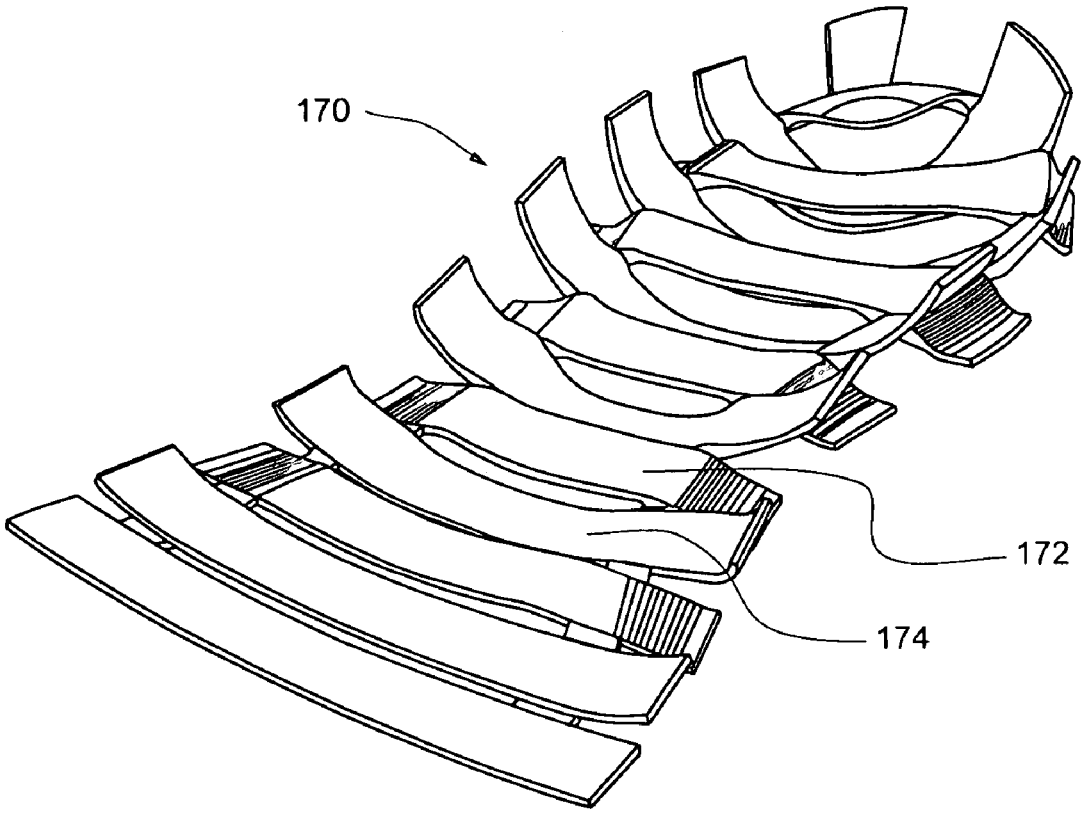
FIG. 10A is a perspective view of an embodiment of a structure with central leaf springs (three-quarters length) for a right shoe of an embodiment of the present invention.
Figure 10B:
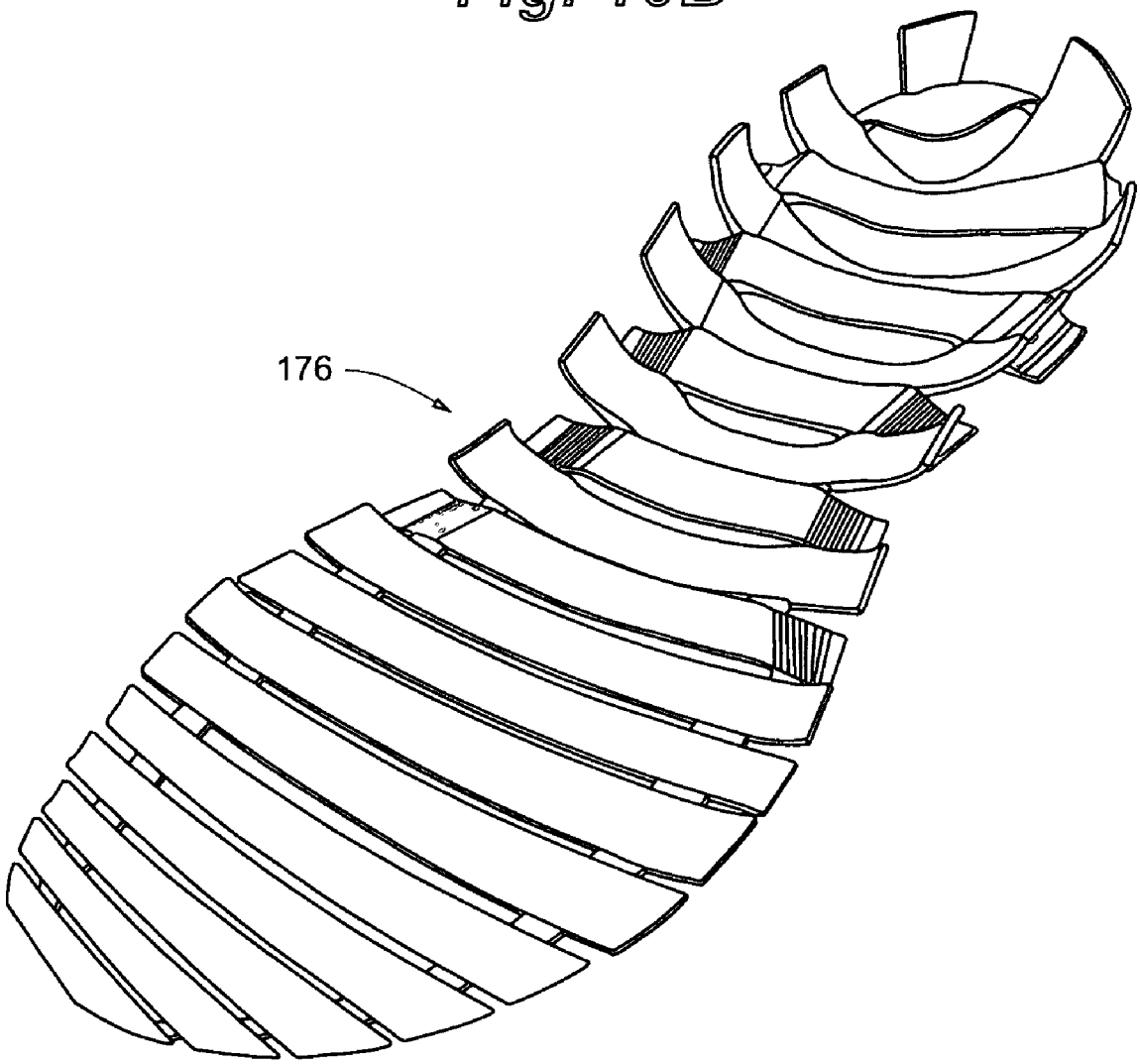
FIG. 10B is a perspective view of an embodiment of a structure with central leaf springs (full length) for a right shoe of the present invention.
Figure 10C:
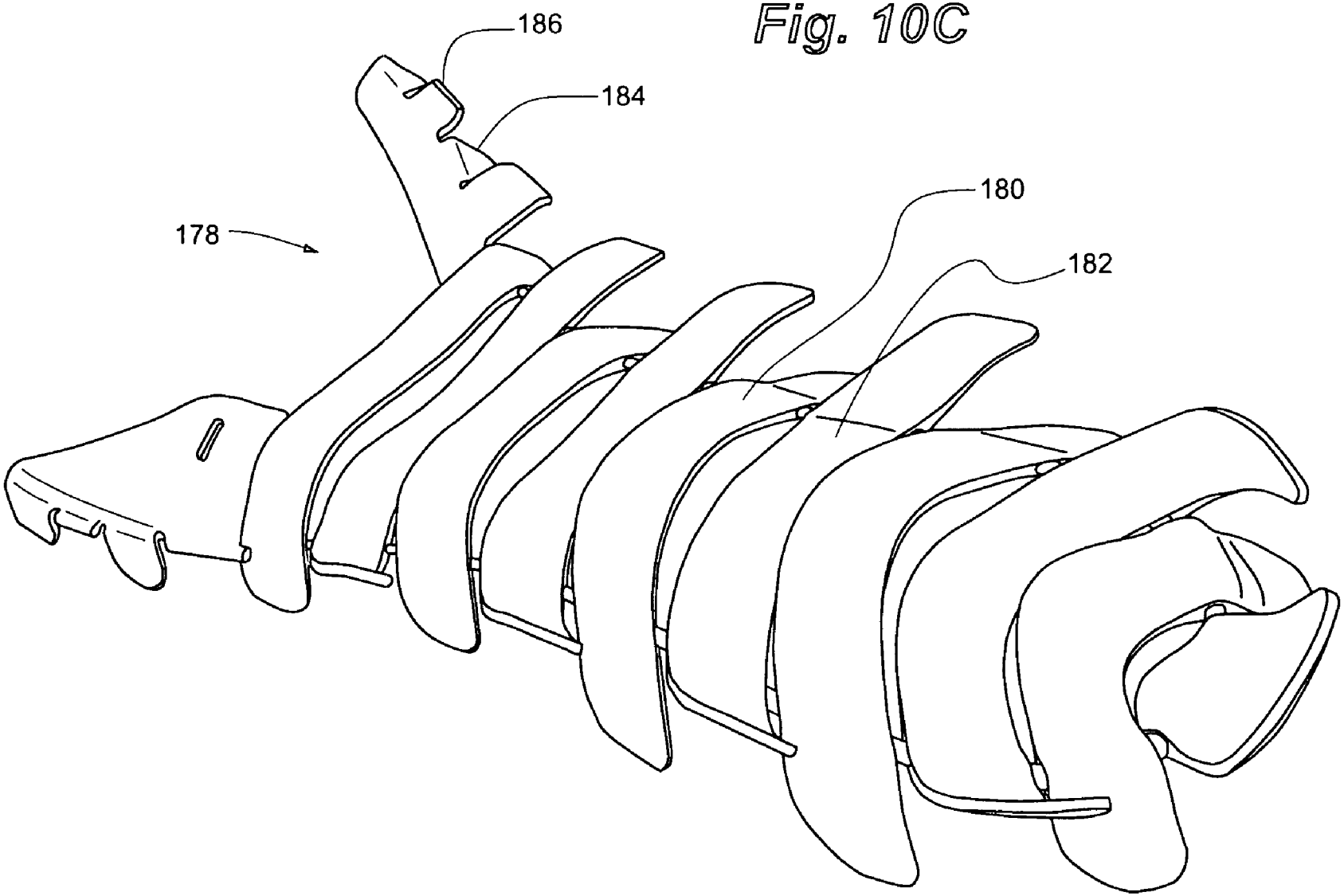
FIG. 10C is a perspective view of an embodiment of a structure with central leaf springs (three-quarters length) with for a right shoe of the present invention.

Additionally, the length of the structure may be tuned to direct support from the leaf springs to various areas of the shoe sole. For example, FIG. 10A shows an embodiment 170 of the structure that includes a series of concavely 172 and convexly curved leaf springs 174 which extends from a heel to three-quarters the length of the shoe sole. Another embodiment, shown in FIG. 10B, includes a structure 176 that is adapted to extend from a rearfoot portion to a forefoot portion of a shoe sole of the present invention. In one embodiment, show in FIG. 10C, a structure 178 includes a series of concavely 180 and convexly 182 curved leaf springs adapted to extend from a heel to three-quarters the length of a shoe sole. The structure of FIG. 10C further includes upper 184 and lower extensions 186 that extend forward of the leaf springs 180, 182 into the forefoot portion of a shoe sole.

Figure 11:
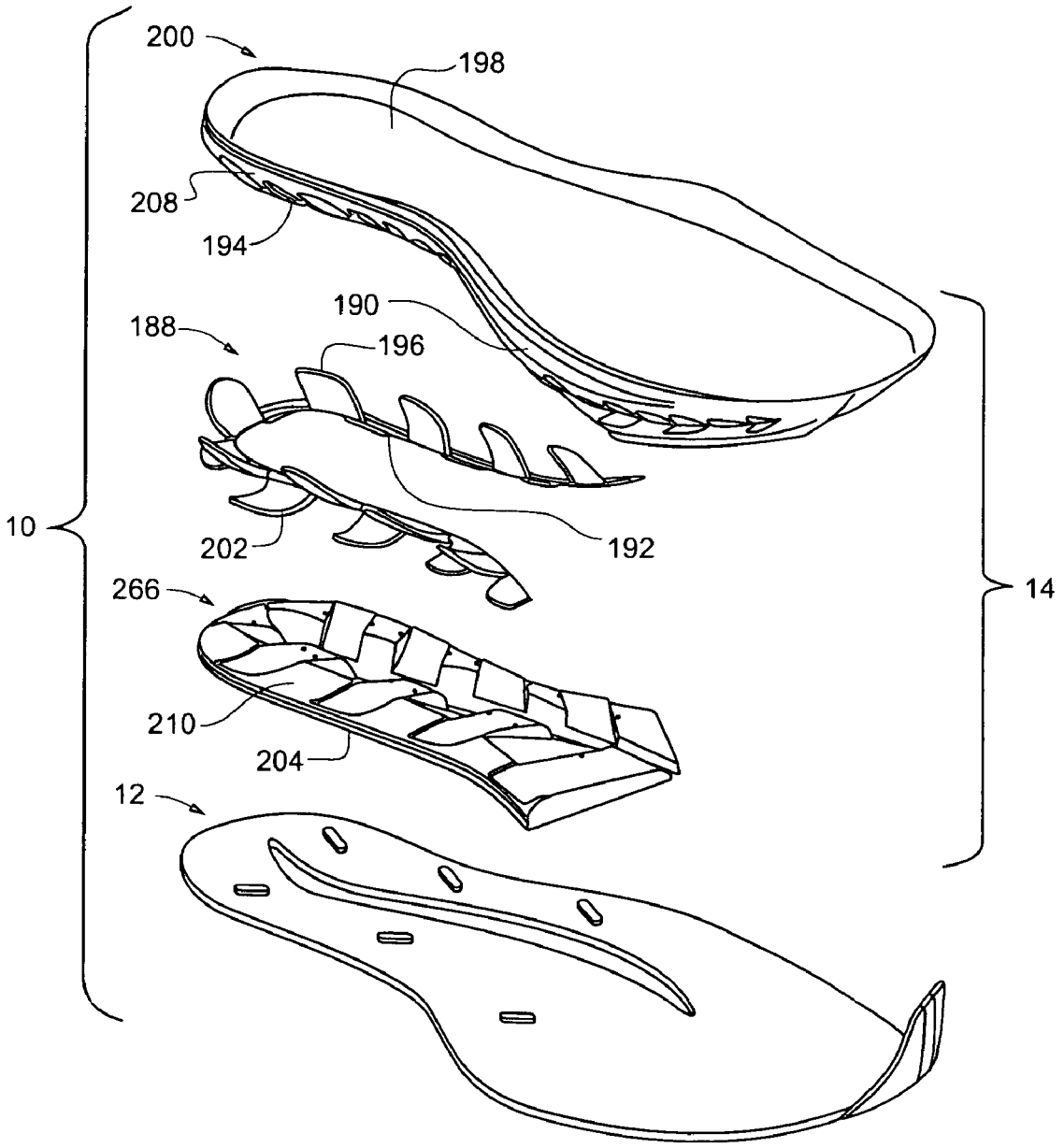
FIG. 11 is an exploded view of an embodiment of a shoe sole with a U-shaped structure for a left shoe of the present invention.

In another embodiment of the present invention, as shown in FIG. 11, a U-shaped structure 188 may used for additional support around at least a rear portion of a shoe sole 45. The U-shaped structure 188 is disposed along the peripheral sidewall 190 along the lateral and medial sides and the heel of shoe sole 45. The U-shaped structure 188 includes a base portion 192 disposed along the horizontal indentation 194 of the shoe sole 45, a first plurality of upper extensions 196 extending outwardly from the base portion 192 toward the upper surface 198 of the upper midsole portion 200, and a second plurality of lower extensions 202 extending outwardly from the base portion 192 toward the lower surface 204 of the lower midsole portion 206. The upper extensions 196 are spaced along the upper peripheral sidewall 208 and the lower extensions 202 are spaced out along the lower peripheral sidewall 210. The lower extensions 202 and upper extensions 196 are arranged in a staggered pattern such that the upper extensions 196 alternate with the lower extensions 202 along the midsole 14. The U-shaped structure 188 may be formed as a structure external to the midsole 14 such that it may be installed after the midsole 14 has been otherwise assembled.

Figure 12:
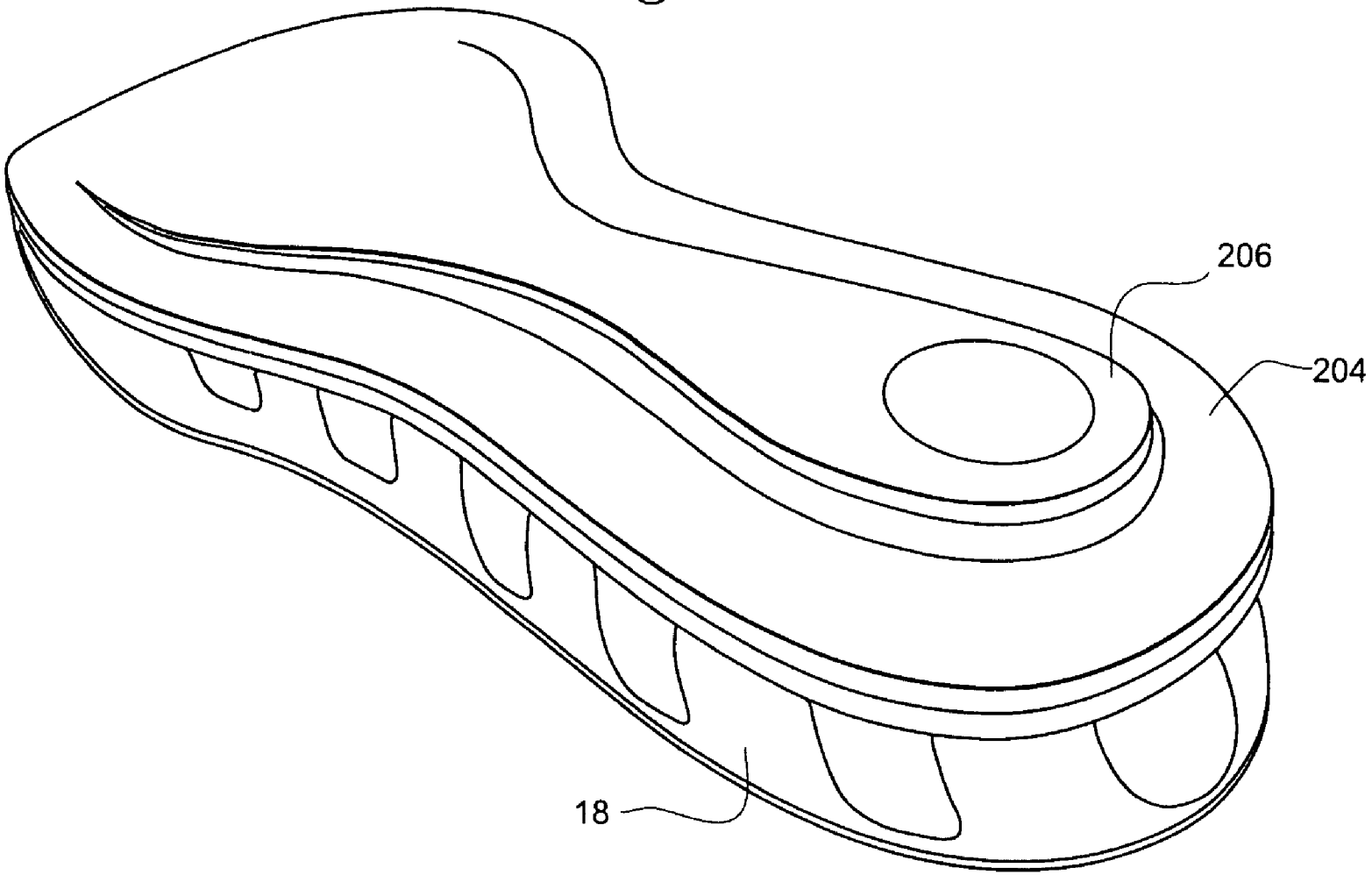
FIG. 12 is a perspective view of a an embodiment of a shoe sole with a raised surface of the present invention.

To induce further instability, any of the embodiments of a shoe sole including a midsole of the present invention can also include an outsole with a lower surface as described in reference to FIGS. 12-16. In one embodiment, as shown in FIG. 12, an outsole 204 has a raised portion 206 that extends along a longitudinal axis of a shoe sole 10, for example, from a forefoot portion to a rearfoot portion of the shoe sole. The raised portion has a width 208 that is less than the width 22 of the upper surface 20 of the midsole 14*b* that underlies the wearer's foot and provides a reduced area for contacting the ground, which promotes further instability in the shoe sole 10. This raised portion 206 can be tuned in concert with the balancing portion 38 of the midsole 14 for example to require the wearer to exert more effort to maintain balance on the ground-engaging portion of the outsole 204 when walking. The height of the raised portion 206 can be varied continuously from the forefoot area of the outsole 204 to the rearfoot area of the outsole 204. The width 208 of the raised portion 206 is preferably varied from the forefoot area of the outsole 204 to the rearfoot area of the outsole 204, for example, outward as shown in the figure. In one embodiment, the width 208 of the raised portion is less than two-thirds of the width 204 of the outsole.

The positioning of the raised portion 206 relative to the longitudinal center of the shoe sole may also be varied from the forefoot area of the outsole 204 to the rearfoot area of the outsole 204, by tuning the positioning of the raised portion 206 relative to the longitudinal center of the outsole 204, the balancing portion 38 of the shoe sole 10 can be changed to target different muscle groups for activation while walking.

Figure 13E:
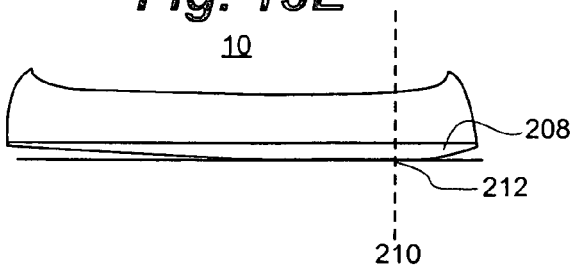
FIGS. 13A, 13B, 13C, 13D and 13E are perspective cross-sectional views of an embodiment of a shoe sole of the present invention taken in the cross-sectional planes of a shoe sole as indicated in FIG. 1, taken along line A-A, B-B, C-C, D-D, and E-E, respectively.
Figure 13D:
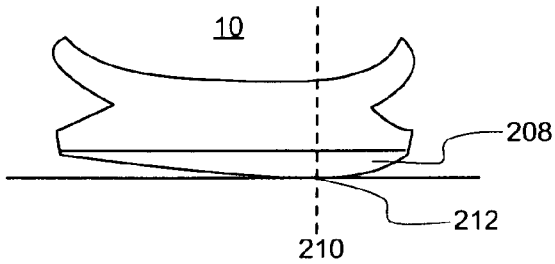
Figure 13C:
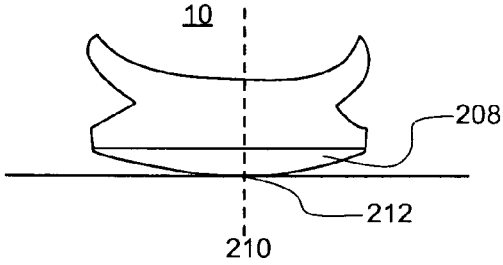
Figure 13B:
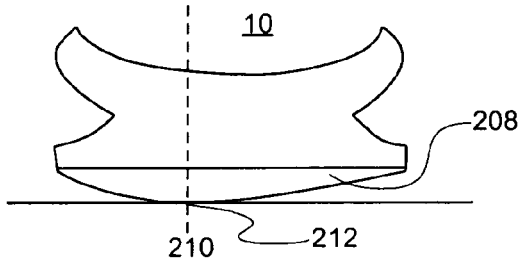
Figure 13A:
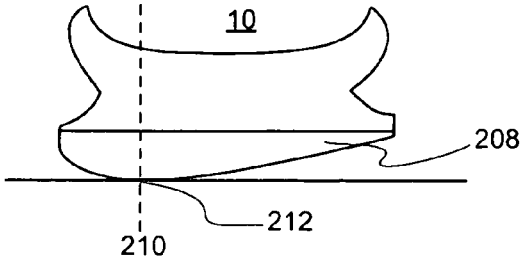

In another embodiment, as shown in FIG. 13A, the outsole 208 can be formed to have a curvature about a longitudinal path 210 of the outsole 208, which can be straight or curved, that runs from a forefoot portion of the shoe sole to a rearfoot portion to enhance the instability of the shoe sole 10. The curvature of a bottom surface of the outsole 208 is formed such that the outsole 208 has a downward protruding portion 212 that engages the ground prior to the adjacent portions nearer to the peripheral edges of the outsole 208. This design forces the wearer to exert more effort to maintain balance over both the balancing portion of the midsole and over the central portion of the outsole 208. The point 212 at which the outsole contacts the ground may be varied from the forefoot portion of the outsole 208 to the rearfoot or heel portion of the outsole 208. By tuning the contact points 212 along the longitudinal axis 210 of the outsole 208 from the forefoot portion of the shoe sole 10 to the rearfoot portion of the shoe sole.

Figure 14A:
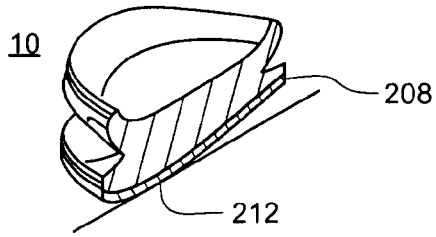
FIGS. 14A, 14B, 14C, 14D and 14E are cross-sectional views of an embodiment of a shoe sole of the present invention taken in the cross-sectional planes of a shoe sole as indicated in FIG. 1, taken along line A-A, B-B, C-C, D-D, and E-E, respectively.
Figure 14B:
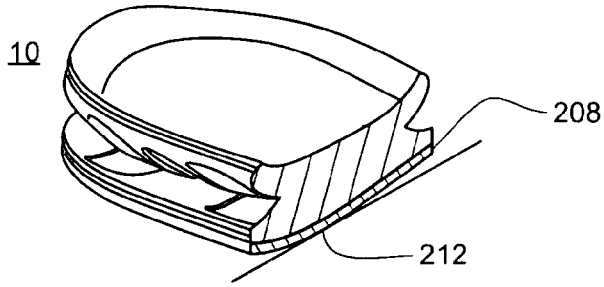
Figure 14C:
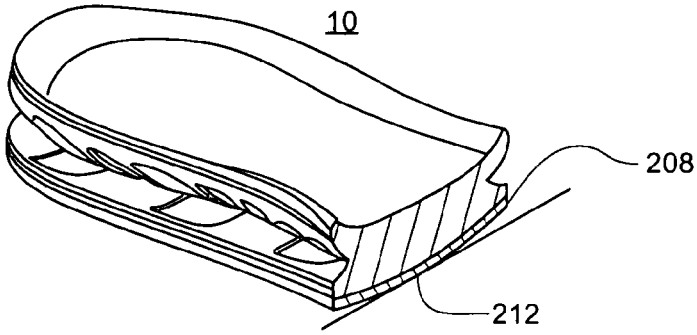
Figure 14D:
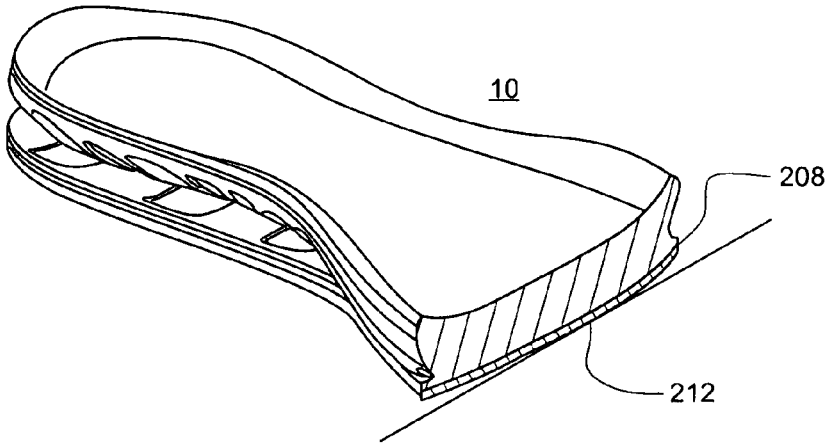
Figure 14E:
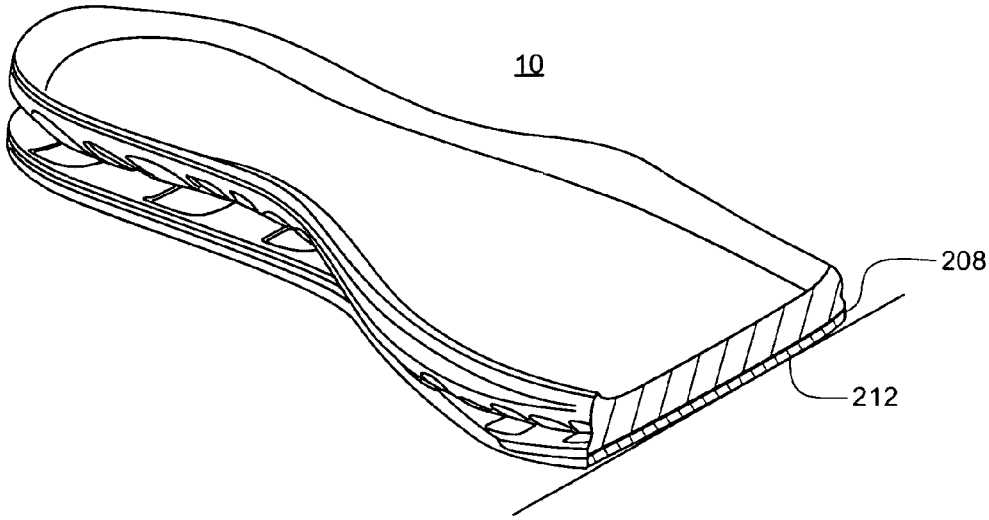

An embodiment of an outsole 208 with a curvature about a longitudinal axis 210 can be seen in FIGS. 13A, 13B, 13C, 13D and 13E, and FIGS. 14A, 14B, 14C, 14D and 14E, which show cross sections of the embodiment 10 of a shoe sole of FIG. 1 at lines A-A, B-B, C-C, D-D, and E-E, respectively. In this embodiment, the contact point 212 in the rearfoot portion of the outsole 208 is toward the medial side of the shoe sole 10, as shown in FIGS. 13A and 14A. The contact point 212 is shifted more towards the center of the shoe sole 10 in the cross section showing points further forward in the in shoe sole 10 in FIGS. 13B and 14B and 13C and 14C. The contact point 212 may be shifted towards the lateral side of the shoe sole 10 in the forefoot portion of the shoe sole 10 as shown in FIGS. 13D and 14D. In one embodiment, the curvature of the outsole 208 may shift toward the extreme lateral side of the shoe sole 10 in the toe area of the shoe sole 10, as shown in FIGS. 13E and 14E.

Additionally, as shown in FIG. 2, a window or a flex groove, preferably a longitudinal flex groove 214, can be positioned through outsole 12 and/or the midsole 14 of the shoe sole 10 of the present invention. The flex groove 214 extends from a forefoot portion of the shoe sole 10 to a rearfoot portion of the shoe sole 10. The flex groove 214 allows the movement of the medial and lateral sides of the shoe sole 10 to be isolated from each other. The location of the flex groove 214 relative to the longitudinal center of the shoe sole may be varied from the forefoot portion of the shoe sole 10 to the rearfoot portion of the shoe sole 10. In one embodiment, the location of the flex groove 214 follows the positioning of the balancing portion 38 of the shoe sole 10 from the forefoot portion the shoe sole 10 to the rearfoot portion of the shoe sole 10.

Figure 15:
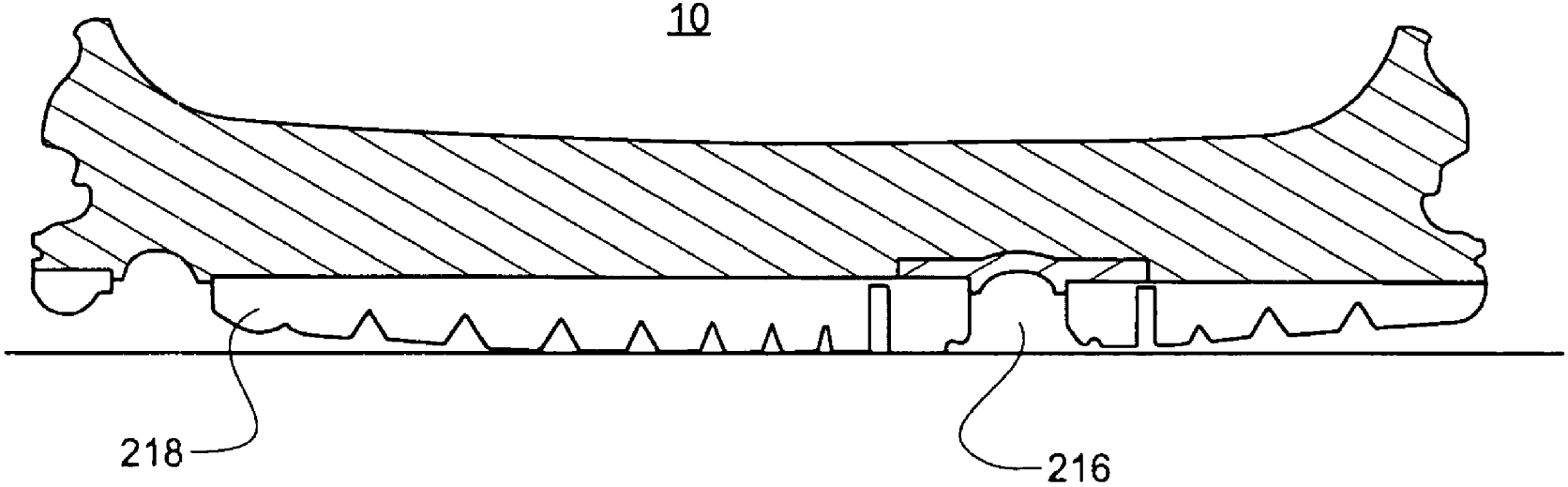
FIG. 15 is a cross-section view in the forefoot portion of an embodiment of a shoe sole of the present invention.
Figure 16A:
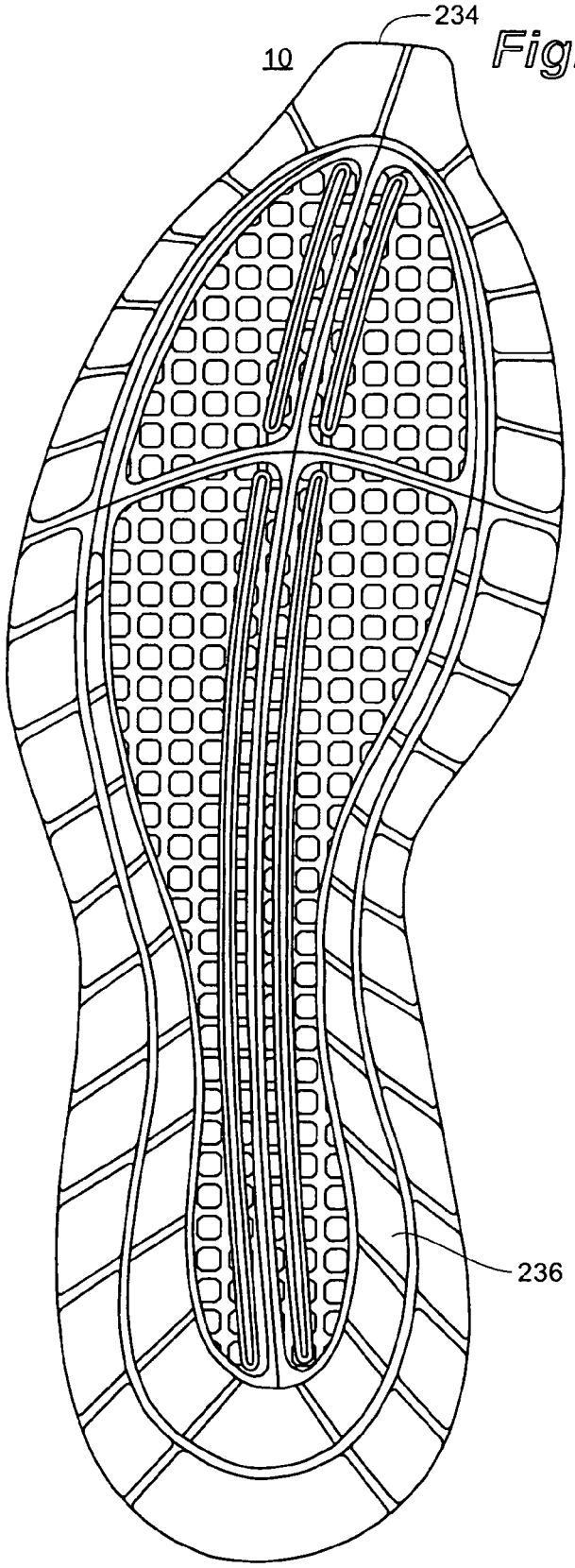
FIG. 16A is a bottom view of an embodiment of a shoe sole with a flex groove of the present invention.
Figure 16B:
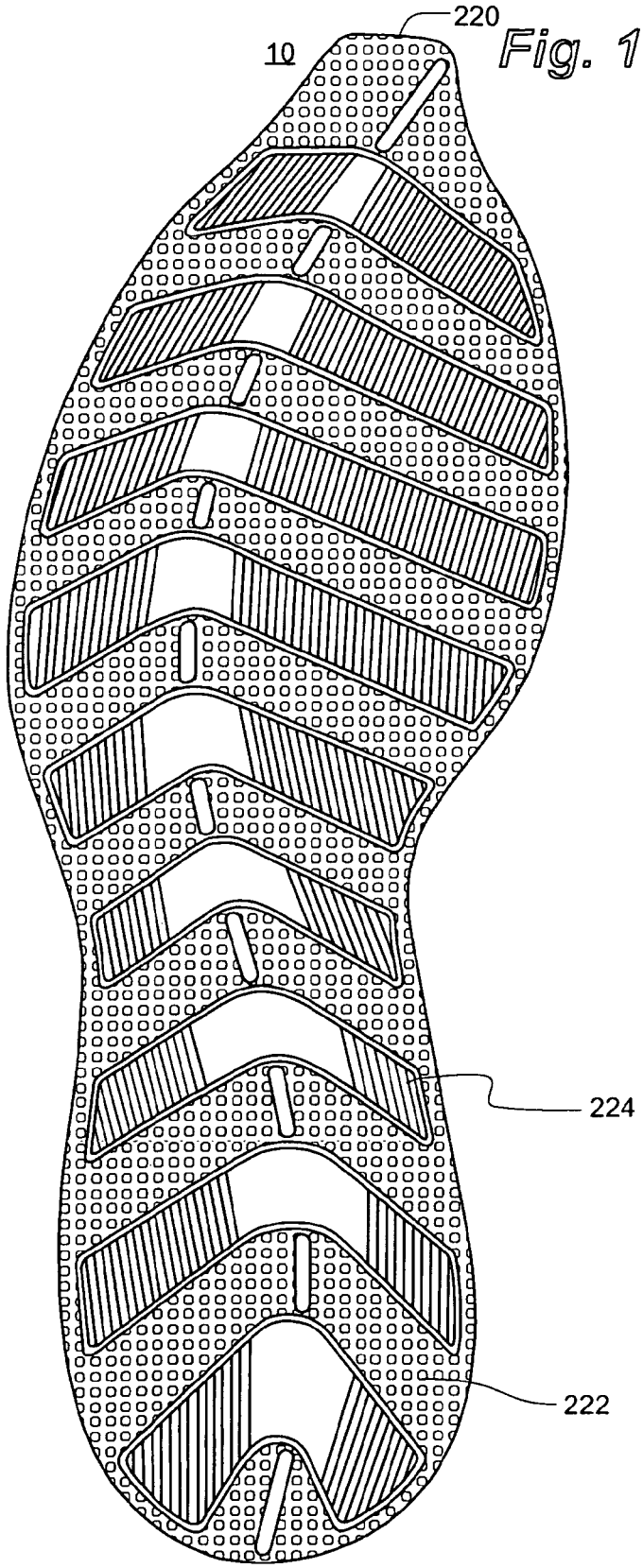
FIG. 16B is a bottom view of an embodiment of a shoe sole with a flex groove of the present invention.
Figure 16C:
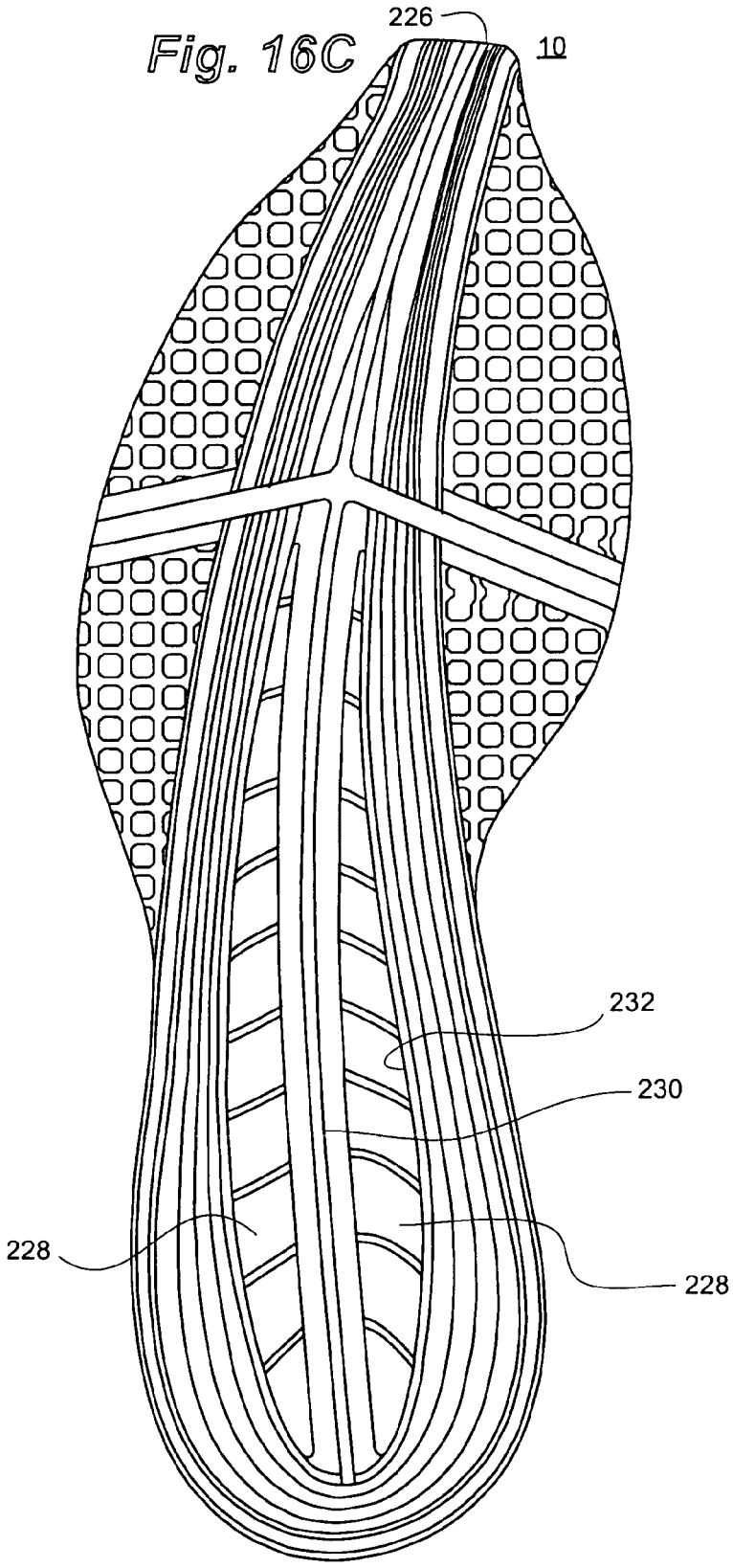
FIG. 16C is a bottom view of an embodiment of a shoe sole with a flex groove of the present invention.

FIG. 2 shows a cross section in the rearfoot portion of a shoe sole 10 with a flex groove 214 of the present invention. As can be seen, the flex groove 214 consists of an absence of the lower midsole portion 18 and outsole 12 in a longitudinally center-to-medial portion of a shoe sole. FIG. 15 shows a cross-section in the forefoot portion of a shoe sole of the present invention with a flex groove 216. In this embodiment, the flex groove 216 has been shifted to the lateral side of the forefoot portion of the shoe sole and consists on the absence of outsole 218 material. FIG. 16B shows a bottom view of a shoe sole with a flex groove 222 of the present invention. In this embodiment, the flex groove 222 consists of an absence of the lower midsole portion 224 along a central longitudinal area of a shoe sole. The flex groove 222 also consists of portion of the outsole 220 being absent along the same path. An alternative embodiment of a shoe sole with a flex groove 228 of the present invention can be seen in FIG. 16C. In this embodiment, the shoe sole has two flex grooves 228 that extend from a forefoot portion of the shoe sole 10 to a rearfoot portion of the shoe sole. The two flex grooves 228 are separated by a central portion 230 of shoe sole where the midsole 232 and outsole 226 are present. Another embodiment of a shoe sole with a flex groove 236 of the present invention can be seen in FIG. 16A. In this embodiment, the flex groove 236 extends along in a U-shape along the lateral and medial sides and connects in the rearfoot portion of a shoe sole formed in accordance with the present invention.

As can be seen from the description above, the shoe sole of the present invention provides various means through which it can be tuned to require a wearer to have to exert additional effort in order to maintain one's balance, thereby promoting the wearer's conditioning and toning.

Any of the embodiments of a shoe sole, or of the embodiments of a structure and a shoe sole incorporating such structure, can be incorporated into a sandal, or into a shoe having an upper, or into any other article of footwear. Accordingly, an article of footwear incorporating any of the embodiments described herein is also within the scope of the invention. Such articles of footwear can be used, for example, as a walking shoe, a leisure or casual shoe, or a training shoe.

Although illustrative embodiments of the present invention have been described herein with reference to the accompanying drawings, it is to be understood that the invention is not limited to those precise embodiments, and that various other changes and modifications may be applied therein by one skilled in the art without departing from the scope or spirit of the invention.

What is claimed is:

1. A shoe sole for an article of footwear, said shoe sole comprising:

a heel portion, a midfoot portion, and a forefoot portion;

a medial side and a lateral side; and a midsole, said midsole comprising:

an upper surface, said upper surface having a width that underlies and supports a wearer's foot;

an upper midsole portion and a lower midsole portion disposed adjacent and below said upper midsole portion in at least said heel portion;

a lower surface; and a peripheral sidewall between said upper surface and said lower surface, wherein said upper midsole portion of at least said heel portion is undercut at its periphery to define a horizontal indentation having a depth in said peripheral sidewall of said midsole along said medial and lateral side and a balancing portion therebetween, said horizontal indentation further extending along a rear of said heel portion, said peripheral sidewall comprising an upper peripheral sidewall angled upward from said horizontal indentation toward said upper surface and a lower peripheral sidewall angled downward from said horizontal indentation toward said lower surface to form a peripheral gap that widens in a direction away from a center of said shoe sole, and wherein said balancing portion has a width less than said width of said upper surface of said midsole, said midsole being adapted to upset a wearer's balance transversely to a longitudinal axis of said shoe sole, thereby forcing a wearer of said article of footwear to adjust one's walking gait to maintain a center of pressure over said balancing portion, and wherein said depth of said horizontal indentation varies along its length.

2. The shoe sole of claim 1, wherein said depth of said horizontal indentation in said heel portion is deeper on said lateral side than on said medial side.

3. The shoe sole of claim 1, wherein said horizontal indentation extends into said midfoot portion along said medial and lateral side.

4. The shoe sole of claim 3, wherein said horizontal indentation further extends into said forefoot portion along at least one of said medial and said lateral side.

5. The shoe sole of claim 4, wherein said depth of said horizontal indentation in said heel portion is deeper on said lateral side than on said medial side, and wherein said depth of said horizontal indentation is deeper in said forefoot portion on said medial side than on said lateral side of said shoe sole.

6. The shoe sole of claim 1, wherein said depth of said horizontal indentation along a substantial portion of at least one of said medial and lateral side in said heel portion is at least 14% of said width of said upper surface of said midsole at that portion.

7. The shoe sole of claim 1, wherein a height of said gap at the outer perimeter of said midsole in said heel portion increases to at least 45% of a thickness of said midsole in said heel portion.

8. The shoe sole of claim 1, wherein said upper midsole portion is an upper layer and said lower midsole portion is a lower layer comprising a material that is of a different density than that of said upper layer.

9. The shoe sole of claim 1, wherein said upper midsole portion and said lower midsole portion are of unitary construction.

10. The shoe sole of claim 1, further comprising:

a structure disposed along at least one of said medial and lateral sides on said peripheral sidewall, said structure comprising:

a base portion positioned along said horizontal indentation; and a first plurality of upper extensions, said upper extensions being spaced apart along said upper peripheral sidewall, said upper extensions extending outwardly from said base portion and toward said upper surface.

11. The shoe sole of claim 10, said structure further comprising:

a second plurality of lower extensions, said lower extensions being spaced apart along said lower peripheral portion, said lower extensions extending outwardly from said base portion and toward said lower surface, wherein said first plurality of upper extensions is staggered with said second plurality of lower extensions such that said upper extensions are arranged in an alternating pattern with said lower extensions along said base portion.

12. The shoe sole of claim 8, said shoe sole further comprising:

a structure disposed along at least one of said medial and lateral side on said peripheral sidewall, said structure comprising:

a base portion positioned along said horizontal indentation; and a plurality of upper extensions, said upper extensions being spaced apart along said upper peripheral sidewall, said upper extensions extending outwardly from said base portion and toward said upper surface, wherein said structure comprises an anchoring tab extending inwardly from said base portion and toward said lower surface, said anchoring tab formed integrally from at least one of said plurality of upper extensions.

13. The shoe sole of claim 1, further comprising:

a structure disposed along at least one of said medial and lateral sides on said peripheral sidewall, said structure comprising:

a base portion positioned along said horizontal indentation; and a plurality of lower extensions, said lower extensions being spaced apart along said lower peripheral sidewall on each of said medial and lateral side, said lower extensions extending outwardly from said base portion and toward said lower surface.

14. The shoe sole of claim 1, further comprising:

a structure disposed on said peripheral sidewall in said heel portion and said midfoot portion along said medial and lateral side and into said forefoot portion along at least one of said medial and lateral side, said structure comprising: a base portion positioned along said horizontal indentation;

a first plurality of upper extensions, said upper extensions being spaced apart along said upper peripheral sidewall, said upper extensions extending outwardly from said base portion and toward said upper surface; and a second plurality of lower extensions, said lower extensions being spaced apart along said lower peripheral sidewall, said lower extensions extending outwardly from said base portion and toward said lower surface, wherein said first plurality of upper extensions is staggered with said second plurality of lower extensions such that said upper extensions are arranged in an alternating pattern with said lower extensions along said base portion.

15. The shoe sole of claim 1, further comprising:

a structure disposed along at least one of said medial and lateral side on said peripheral sidewall in at least said heel portion, said structure comprising:

a base portion positioned along said horizontal indentation;

a first plurality of upper extensions, said upper extensions being spaced apart along said upper peripheral sidewall, said upper extensions extending outwardly from said base portion and toward said upper surface; and a second plurality of lower extensions, said lower extensions being spaced apart along said lower peripheral portion, said lower extensions extending outwardly from said base portion and toward said lower surface, wherein said first plurality of upper extensions is staggered with said second plurality of lower extensions such that said upper extensions are arranged in an alternating pattern with said lower extensions along said base portion, wherein a width of at least one of said upper and lower extensions on said lateral side is greater than a width of at least one of said upper and lower extensions on said medial side.

16. The shoe sole of claim 1, further comprising:

a U-shaped structure disposed on said peripheral sidewall around a rear of said heel portion and along said medial and lateral side of said shoe sole, said structure comprising:

a base portion positioned along said horizontal indentation;

a first plurality of upper extensions, said upper extensions being spaced apart along said upper peripheral sidewall, said upper extensions extending outwardly from said base portion and toward said upper surface; and a second plurality of lower extensions, said lower extensions being spaced apart along said lower peripheral sidewall, said lower extensions extending outwardly from said base portion and toward said lower surface, wherein said first plurality of upper extensions is staggered with said second plurality of lower extensions such that said upper extensions are arranged in an alternating pattern with said lower extensions along said base portion, wherein said U-shaped structure is an external structure adapted to be fixed to said midsole after assembly thereof.

17. The shoe sole of claim 1, said shoe sole further comprising an outsole disposed below said lower surface of said midsole, wherein said outsole has a lower surface comprising a raised portion having a width less than said width of said upper surface of said midsole and adapted to promote instability in a wearer's walking gait, said raised portion protruding generally from the center of said outsole at least in said heel portion of said shoe sole.

18. The shoe sole of claim 17, wherein a height of said raised portion increases in a direction from said forefoot portion toward the rear of said heel portion of said shoe sole.

19. The shoe sole of claim 17, wherein said width of said raised portion is less than two-thirds of the width of said outsole.

20. The shoe sole of claim 1, said shoe sole further comprising an outsole disposed below said lower surface of said midsole, at least a portion of said outsole extending from said forefoot to said heel portion of said shoe sole.

21. A shoe sole for an article of footwear, said shoe sole comprising:

a heel portion, a midfoot portion, and a forefoot portion;

a medial side and a lateral side; and a midsole, said midsole comprising:

an upper surface, said upper surface haying a width that underlies and supports a wearer's foot;

an upper midsole layer and a lower midsole layer disposed below said upper midsole layer in at least said heel portion;

a lower surface; and a peripheral sidewall between said upper surface and said lower surface, wherein said upper midsole layer of at least said heel portion is undercut at its periphery to define a horizontal indentation having a depth in said peripheral sidewall of said midsole along said medial and lateral side and a balancing portion therebetween, said peripheral sidewall comprising an upper peripheral sidewall angled upward from said horizontal indentation toward said upper surface and a lower peripheral sidewall angled downward from said horizontal indentation toward said lower surface to form a peripheral gap that widens in a direction away from a center of said shoe sole, and wherein said balancing portion has a width less than said width of said upper surface of said midsole, said midsole being adapted to upset a wearer's balance transversely to a longitudinal axis of said shoe sole, thereby forcing a wearer of said article of footwear to adjust one's walking gait to maintain a center of pressure over said balancing portion; and a structure disposed along said medial and lateral side on said peripheral sidewall, said structure comprising:

a base portion positioned along said horizontal indentation;

a first plurality of lower extensions, said lower extensions being spaced apart along said lower peripheral sidewall on each of said medial and lateral side, said lower extensions extending outwardly from said base portion and toward said lower surface;

a second plurality of upper extensions, said upper extensions being spaced apart along said upper peripheral sidewall on each of said medial and lateral side, said upper extensions extending outwardly from said base portion and toward said upper surface; and a central portion disposed between said upper midsole layer and said lower midsole layer, said central portion comprising:

a plurality of concavely curved leaf springs, each of said concavely curved leaf springs being formed in a continuous upward arc from one of said lower extensions on said lateral side and one of said lower extensions on said medial side; and a plurality of convexly curved leaf springs, each of said convexly curved leaf springs being formed in a continuous downward arc from one of said upper extensions on said lateral side and one of said upper extensions on said medial side, wherein said second plurality of upper extensions is staggered with said first plurality of lower extensions such that said upper extensions are arranged in an alternating pattern with said lower extensions along said base portion, and said plurality of concavely curved leaf springs is staggered with said plurality of convexly curved leaf springs such that said concavely curved leaf springs are arranged in an alternating pattern with said convexly curved leaf springs.

22. The shoe sole of claim 21, said shoe sole further comprising an outsole disposed below said lower surface of said midsole, wherein said outsole has a lower surface comprising a raised portion having a width less than said width of said upper surface of said midsole and adapted to promote instability in a wearer's walking gait, said raised portion protruding generally from the center of said outsole at least in said heel portion of said shoe sole.

23. The shoe sole of claim 22, wherein a height of said raised portion increases in a direction from said forefoot portion of said outsole toward the rear of said heel portion of said shoe sole.

24. The shoe sole of claim 22, wherein said width of said raised portion is less than two-thirds of the width of said outsole.

25. The shoe sole of claim 21, said shoe sole further comprising an outsole disposed below said lower surface of said midsole, at least a portion of said outsole extending from said forefoot to said heel portion of said shoe.

26. A shoe sole for an article of footwear, said shoe sole comprising:

a medial side and a lateral side;

a midsole, said midsole comprising:

an upper surface, said upper surface having a width that underlies and supports a wearer's foot; and a lower surface; and a structure disposed between said upper surface and said lower surface, said structure comprising:

a base portion, said base portion comprising a medial base portion positioned on said medial side of said shoe sole and a lateral base portion positioned on said lateral side of said shoe sole;

a central portion disposed between said lateral base portion and said medial base portion, said central portion comprising:

a plurality of concavely curved leaf springs, each of said concavely curved leaf springs being formed in a continuous upward arc toward a center of said shoe sole from said lateral base portion and from said medial base portion; and a plurality of convexly curved leaf springs, each of said convexly curved leaf springs being formed in a continuous downward arc toward a center of said shoe sole from said lateral base portion and said medial base portion;

an upper midsole layer; and a lower midsole layer extending below said upper midsole layer, wherein said upper midsole layer comprises a lower surface and said lower midsole layer comprises an upper surface, said lower surface of said upper midsole layer comprising recesses for receiving said concavely curved leaf springs and said upper surface of said lower midsole layer comprising recesses for receiving said convexly curved leaf springs, said lower midsole layer forming a gasket between said lower surface of said midsole and said leaf springs.

27. The shoe sole of claim 26, wherein said concavely curved leaf springs are arranged in an alternating pattern with said convexly curved leaf springs.

28. The shoe sole of claim 26, wherein said lower midsole layer has a window therethrough that exposes a portion of said plurality of concavely and convexly curved leaf springs.

29. A shoe sole for an article of footwear, said shoe sole comprising:

a heel portion, a midfoot portion, and a forefoot portion;

a medial side and a lateral side; and a midsole, said midsole comprising:

an upper surface, said upper surface having a width that underlies and supports a wearer's foot;

an upper midsole layer;

a lower midsole layer disposed below said upper midsole layer in at least said heel portion; a lower surface; and a peripheral sidewall between said upper surface and said lower surface, wherein said upper midsole layer of at least said heel portion is undercut at its periphery to define a horizontal indentation having a depth in said peripheral sidewall of said midsole along said medial and lateral side and a balancing portion therebetween, said peripheral sidewall comprising an upper peripheral sidewall angled upward from said horizontal indentation toward said upper surface and a lower peripheral sidewall angled downward from said horizontal indentation toward said lower surface to form a peripheral gap that widens in a direction away from a center of said shoe sole, and wherein said balancing portion has a width less than said width of said upper surface, said midsole being adapted to upset a wearer's balance transversely to a longitudinal axis of said shoe sole, thereby forcing a wearer of said article of footwear to adjust one's walking gait to maintain a center of pressure over said balancing portion; and a structure disposed along said medial and lateral side on said peripheral sidewall, said structure comprising:

a base portion positioned along said horizontal indentation;

a first plurality of lower extensions, said lower extensions being spaced apart along said lower peripheral portion on each of said medial and lateral side, said lower extensions extending outwardly from said base portion and toward said lower surface; and a central portion disposed between said upper midsole layer and said lower midsole layer, said central portion comprising a plurality of concavely curved leaf springs, each of said concavely curved leaf springs being formed in a continuous arc upward from one of said lower extensions on said lateral side and one of said lower extensions on said medial side.

30. The shoe sole of claim 29, said structure further comprising:

a second plurality of upper extensions, said upper extensions being spaced apart along said upper peripheral sidewall on each of said medial and lateral side, said upper extensions extending outwardly from said base portion and toward said upper surface;

said central portion further comprising a plurality of convexly curved leaf springs, each of said convexly curved leaf springs being formed in a continuous arc downward from one of said upper extensions on said lateral side and one of said upper extensions on said medial side, wherein said second plurality of upper extensions is staggered with said first plurality of lower extensions such that said upper extensions are arranged in an alternating pattern with said lower extensions along said base portion.

31. The shoe sole of claim 30, wherein a height of at least one of said plurality of concavely curved leaf springs is greater than a height of at least one of said plurality of convexly curved leaf springs.

* * * * *